US010020131B2

(12) United States Patent
Chen

(10) Patent No.: US 10,020,131 B2
(45) Date of Patent: Jul. 10, 2018

(54) TRANSFORMER TAPPING ARRANGEMENT AND METHODS OF OPERATION OF SAME

(71) Applicants: Jianping Hou, BC (CA); Zheng Chen, BC (CA); Roy Horne, Leicestershire (GB); David Simon Fishman, Shropshire (GB); Min Chen, Nottingham (GB)

(72) Inventor: Min Chen, Nottingham (GB)

( * ) Notice: Subject to any disclaimer, the term of this patent is extended or adjusted under 35 U.S.C. 154(b) by 257 days.

(21) Appl. No.: 14/441,843

(22) PCT Filed: Dec. 3, 2013

(86) PCT No.: PCT/GB2013/000525

§ 371 (c)(1),
(2) Date: May 9, 2015

(87) PCT Pub. No.: WO2014/087123

PCT Pub. Date: Jun. 12, 2014

(65) Prior Publication Data

US 2015/0311006 A1 Oct. 29, 2015

(30) Foreign Application Priority Data

Dec. 3, 2012 (GB) ..... 1221737.8
Jun. 11, 2013 (GB) ..... 1310339.5

(51) Int. Cl.

| | |
|---|---|
| ***H01H 19/00*** | (2006.01) |
| ***H01H 21/00*** | (2006.01) |
| ***H01H 9/00*** | (2006.01) |
| ***H01H 19/56*** | (2006.01) |
| ***H01H 1/20*** | (2006.01) |
| ***H01H 3/38*** | (2006.01) |

(52) U.S. Cl.
CPC ..... *H01H 9/0027* (2013.01); *H01H 1/2041* (2013.01); *H01H 3/38* (2013.01); *H01H 9/0038* (2013.01); *H01H 19/563* (2013.01); *H01H 2235/01* (2013.01)

(58) Field of Classification Search
CPC ..... H01H 9/0027; H01H 9/0038; H01H 3/38; H01H 1/2041; H01H 19/563; H01H 2235/01; Y10T 74/18792; H02K 11/0042; H02K 7/1166; H02K 7/1004; F16H 19/02
USPC ..... 200/11 TC
See application file for complete search history.

(56) References Cited

U.S. PATENT DOCUMENTS

| | | | | |
|---|---|---|---|---|
| 2,231,627 A | | 2/1941 | Jansen | |
| 3,167,703 A | | 1/1965 | Schindler | |
| 3,581,188 A | * | 5/1971 | Watanabe | H01F 27/40 323/340 |
| 4,736,114 A | * | 4/1988 | Reichl | H02B 1/24 200/11 TC |
| 6,693,248 B1 | | 2/2004 | Schultz | |

(Continued)

FOREIGN PATENT DOCUMENTS

GB 605675 A 7/1948

*Primary Examiner* — Edwin A. Leon
*Assistant Examiner* — Lheiren Mae A Caroc
(74) *Attorney, Agent, or Firm* — Nwamu, P.C.

(57) ABSTRACT

A tapping arrangement for a transformer, the arrangement comprising a plurality of fixed contacts, a movable rotary contact, a transition rotor with pairs of transition contacts, an interrupter coupling assembly and driving motor(s) are compacted into a single vacuum chamber.

4 Claims, 20 Drawing Sheets

(56) References Cited

U.S. PATENT DOCUMENTS

2011/0031220 A1* 2/2011 Nilsson ..... H01H 9/0038
218/118

* cited by examiner

TRANSFORMER TAPPING ARRANGEMENT AND METHODS OF OPERATION OF SAME

This invention relates generally to transformer tapping arrangements and more particularly to an integrated vacuum tapping interrupter and methods of operating such arrangements.

It will be understood that transformers are used to provide electrical power at desired voltages, current and power. A transformer tapping or selector arrangement allows a desired number of transformer coil turns to be selected so the transformer can have a variable coil turn ratio and so voltage regulation of the output. The tapping arrangement can change the coils turn ratio in the transformer to keep the output voltage stable. Traditionally an On Load Tap Changer has been used for transformer coil ratio selection with insulation oil used for insulation between the contacts and for cooling. Unfortunately there is inherent electrical arcing as contacts are made and broken which contaminates the insulation oil with arc debris/erosion of the contacts and heat degradation of the oil itself. In such circumstances more recently the problems of insulation oil contamination have been addressed by use of a vacuum interrupter in which the electrical contacts of the transformer tapping or selector arrangement are located in a vacuum chamber to reduce and isolate the electrical arc during the tap or contact switch over and changing operation.

Operation of vacuum interrupters is well known and to an extent depends upon a correct switching sequence for tap change over sequencing and to make sure any electrical arcing occurs in the vacuum interrupters itself rather than in the insulation oil. Such configurations can be achieved with single, double and more vacuum interrupters for each phase in order to minimise electrical arcs occurring during operation. However, as the number of vacuum interrupters increases so the volume of the arrangement increases and the mechanism to operate the arrangement becomes more complicated with an overall reduction in reliability.

In accordance with aspects of the present invention there is provided a tapping arrangement for a transformer, the arrangement comprising a plurality of fixed contacts and a movable rotary contact upon a main axle, the movable rotary contact movable to engage an original fixed contact and a destination fixed contact upon the main axle by lifting, rotation and depression of the main axle using a lift mechanism, a transition rotor arm associated with the main axle and arranged to rotate with the movable rotary contact, the transient rotor having transition rotor arm having two ends with transition contacts in a pair arranged to engage in turn as the rotor end rotates the original fixed contact, bridge the original fixed contact and the destination contact with a transition contact of the pair engaging each and then the destination fixed contact only during a tap change-over, the transition contacts connected through at least one transition resistor The movable rotary contact connected to a main terminal of an electrical power supply.

The transition rotor arms and rollers arm are part of hollow insulating tapping axle which is held by two taper bearings. The main axle is socketed in the hollow insulating tapping axle with lifting and depressing free, but turning together.

The arrangement may have a movable rotary contact associated with a respective fixed contact.

The transition rotor arm may lift and be depressed with the main axle.

The lift mechanism may be arranged to be perpendicular. The lift mechanism having a bias such as a spring loaded element and held with a lock until released whereby the spring stimulates rapid separation of the fixed contact and the rotary contact.

Each transition contact may be connected to a roller engaging a respective ring with the rings electrically coupled to the transition resistor. The rings may be concentric about the main axle. Each transition contact may be under a bias towards electrical contact with fixed contacts.

The conductive bar or wire connected between an external coupling or a main terminal and a slip collar contact arrangement coupled to the rotary contact. The contact lead may be braided wire strands. The contact lead may be a conductive band or bar.

The main axle may be driven by a motor. The motor may be a reluctance electrical motor or a stepping motor. The main axle may be coupled to the motor by a clutch mechanism. The motor may act with a clutch axle to actuate a coupling bias used to ensure engagement between the fixed contacts and the movable rotary contact. The clutch mechanism may act through electromagnetic actuators whereby actuation of the clutch axle is by driving upon a screw thread. There may be an optionally a separate turning motor to drive the movable rotary contact.

The transition contacts in a pair may be substantially at a 90° (or 60°, 45°, 30°) angle to each other on the rotor end. Opposed transition contacts may be electrically connected with electrical insulation to other transition contacts. Transition contacts in adjacent positions are electrically insulated from each other in the rotor end. The rotor ends may be arranged to rotate on a rotor axle. There may be four (or six, eight, twelve) transition contacts. The transition contacts may be reciprocally shaped to engage part of the fixed contacts as the rotor end rotates from the original fixed contact to the destination fixed contact.

The transition resistor may comprise a plurality of electrical resistors connected in series or in parallel to provide a combined electrical resistance. The plurality of electrical resistors may be electively switchable into combinations to vary the combined electrical resistance in use.

The transition resistor with the transition contacts provides a by-pass circuit for electrical load when the movable rotary contacts are not in engagement with the fixed contacts. The by-pass circuit may have an indicator for electrical load. The indicator may be a simple lamp indicating electrical current flow above a threshold. The indicator may be a meter to provide an indication of electrical load.

Also in accordance with aspects of the present invention there is provided a method of operating a tapping arrangement as described above and below.

Further in accordance with aspects of invention there is provided a method of tapping with regard to a transformer whereby an electrical connection between an original fixed contact and a moveable rotary contact is broken by lift of the movable rotary contact on a main axis and such lift also displaces transition rotor arm with a transition rotor at an end such that transition contacts in a pair rotate upon the transition rotor with rotation of the movable rotary contact to a destination fixed contact whereby the pair of transition contacts are configured so that one transition contact is in contact with the original fixed contact at the start of rotation and then the pair of transition contacts bridge the original fixed contact and the destination fixed contact with a respective transition contact engaging on each fixed contact and then through further rotation only the destination fixed contact is engaged by the transition contacts whereupon the movable rotary contact is located above the destination fixed contact and the rotary contact is forced into engagement with the destination fixed contact, there being provided a transition electrical resistance between the transition contacts to take an electrical load when the fixed contacts and the moveable contact are not in conductive engagement with each other.

In accordance with additional aspects of the present invention there is provided a tapping arrangement for a transformer, the arrangement comprising a plurality of fixed contacts and a movable rotary contact upon a main axle, and the movable rotary contact electrically connected by a link coupling the main coupling electrically connected to the link coupling and the link coupling extending to a collar in electrical contact with a slip ring, the collar and slip ring concentric about the main axle and arranged to slip past each other in use, the slip ring in electrical contact with the moveable rotary contact.

The link contact may be a braided conductive wire tape. The slip ring may have a channel or rail to ensure location of the collar and/or ensure electrical connection. The collar and the slip ring may have intermediate connectors between them to facilitate electrical connection. The intermediate connectors may be roller bearings or ball bearings or a conductive belt. The intermediate connectors may be in compression between the slip ring and the collar.

An embodiment of aspects of the present invention will now be described by way of example with reference to the accompanying drawings in which.

Figure 4:
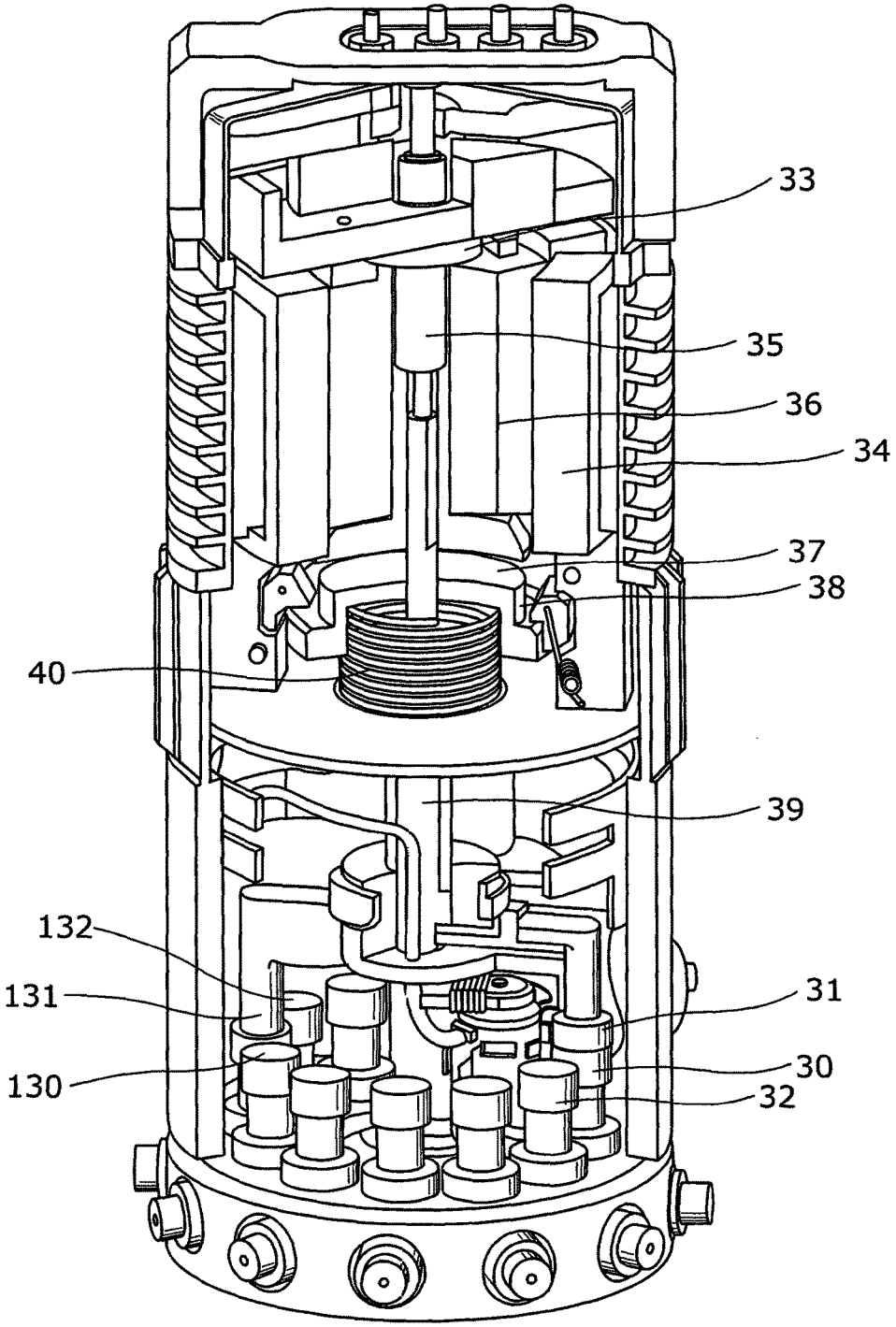
FIG. 4 is a part cutaway cross-section of a tapping arrangement at the start of tapping or change-over process.
Figure 17:
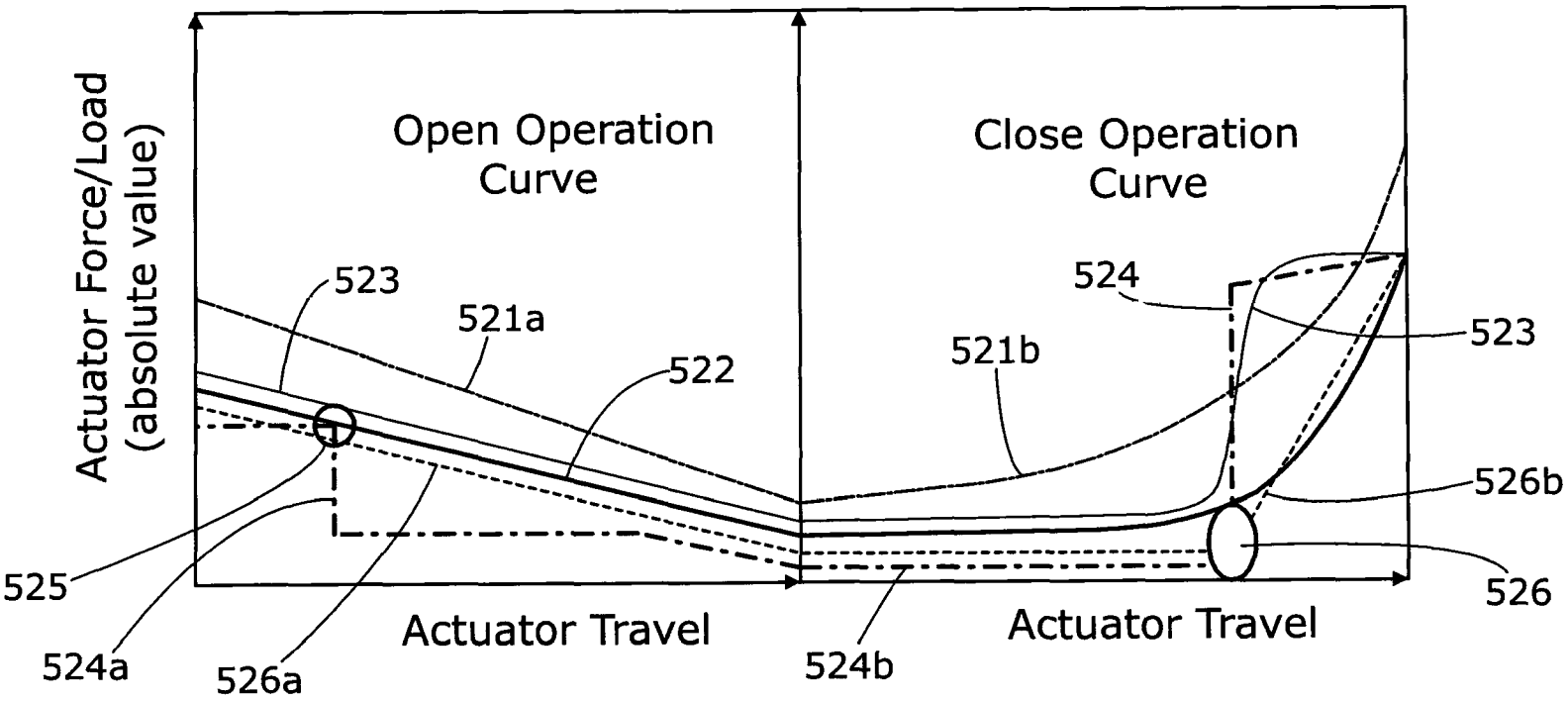
Figure 18:
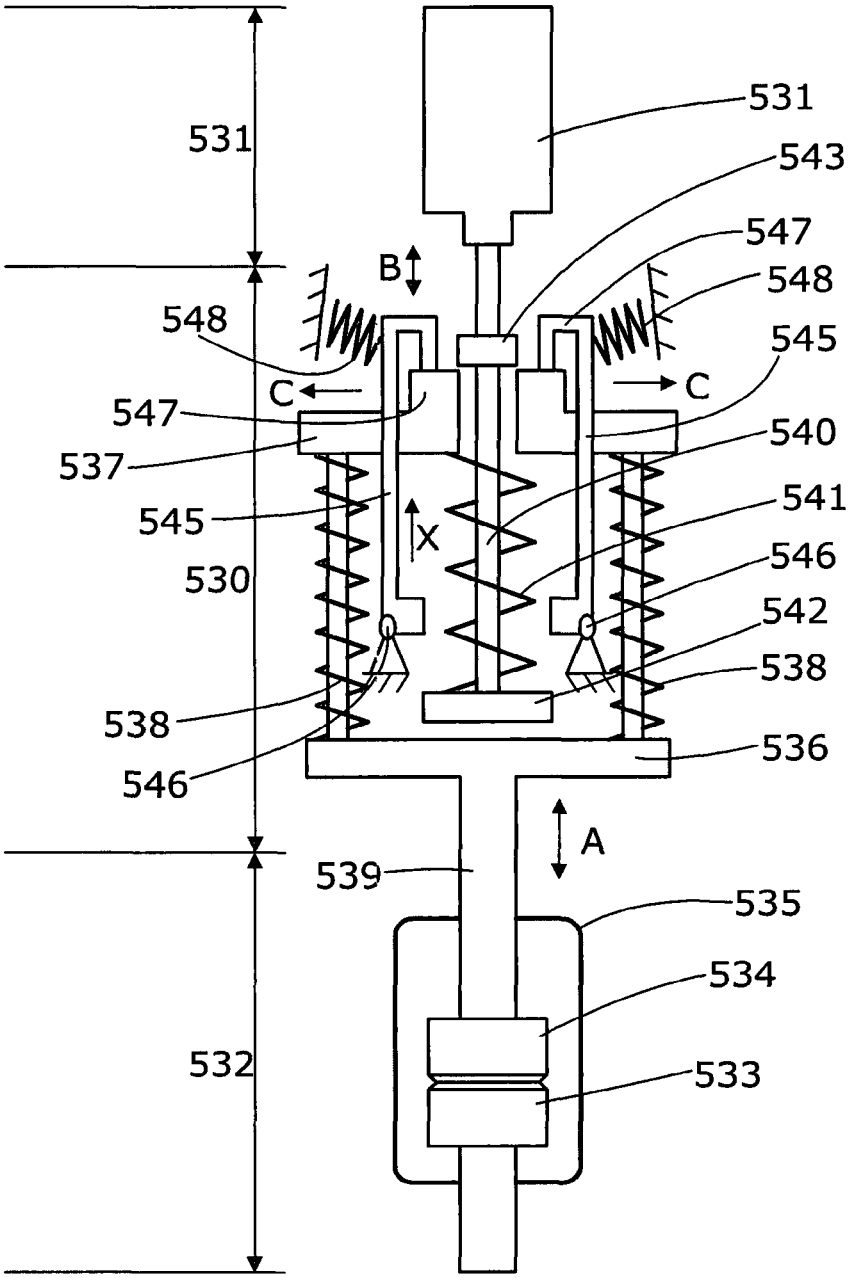
Figure 20C:
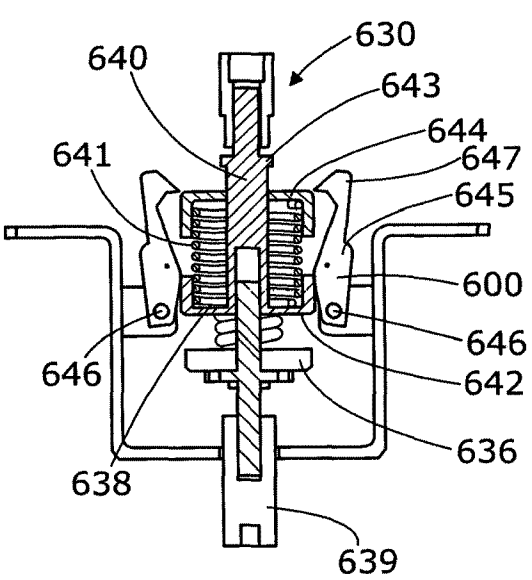
Figure 20B:
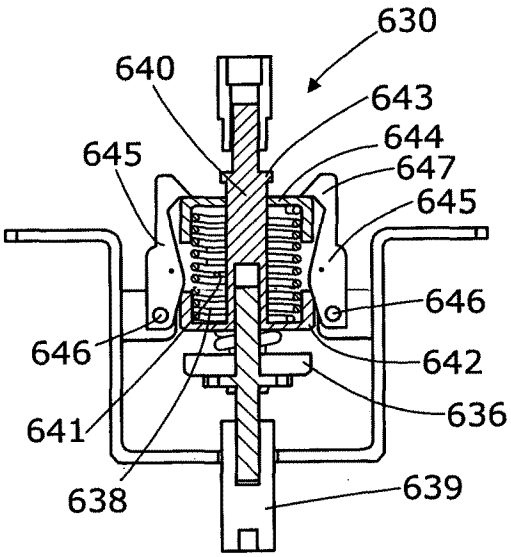
Figure 20A:
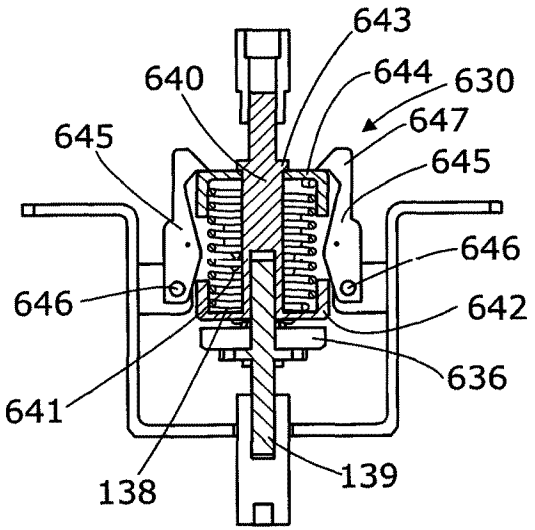
Figure 20E:
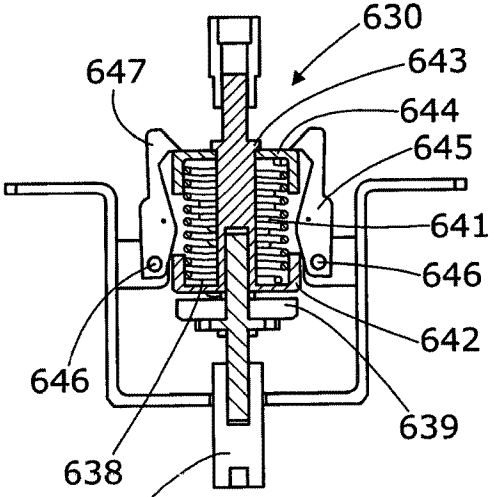
Figure 20D:
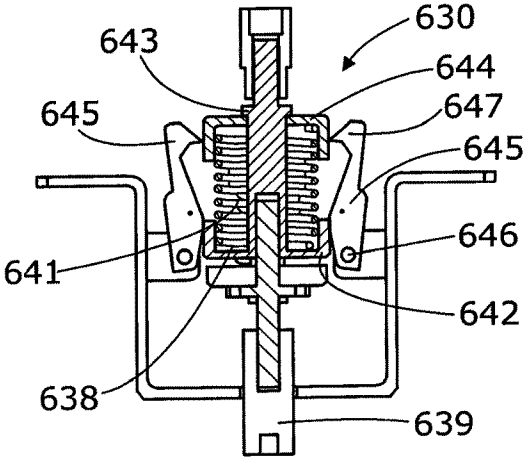
Figure 21:
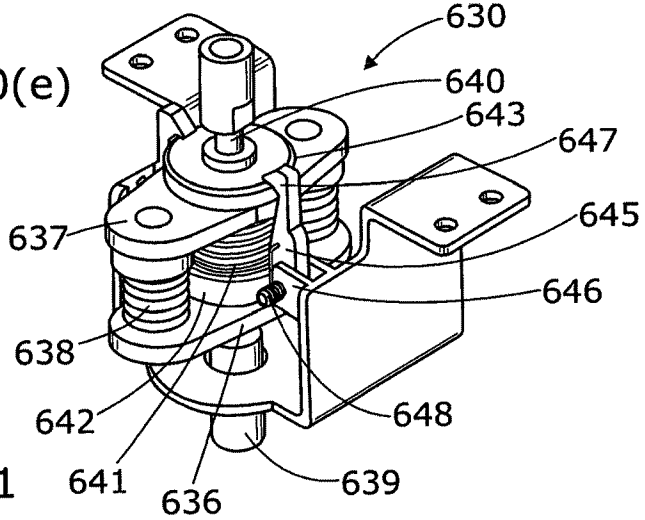

FIG. 17 provided a graph showing operation of an interrupter in accordance with aspects of the present invention in comparison with a prior hybrid spring/electromagnetic actuator;

FIG. 18 is a schematic side cross-section of an interrupter coupling in accordance with aspects of the present invention;

FIG. 19 is a series of schematic illustrations a) to e) showing operations stages with an interrupter coupling according to aspects of the present invention;

FIG. 20 is a series of cross-sections a) to e) of an interrupter coupling assembly in accordance with one embodiment of aspects of the present invention; and, FIG. 21 is a front perspective view of the interrupter coupling assembly as depicted in FIG. 4.

A transformer tap arrangement which combines on load tap changing and an interrupter in a single vacuum chamber will provide significant advantages at least in terms of size and reduced operational complexity and probably also improving reliability. Electrical clearances can be reduced by use of the vacuum and removal of insulation oil will also eliminate this potential for failure or for improper operation. All parts and components are located and sealed within a single chamber typically comprising an upper cap, a middle ceramic tube and, a terminal ceramic base. The internal components as defined below are arranged in a layered stack within the arrangement with a driving motor, a clutch at the top, in a coupling housing, a circular rotation mechanism, a layer of rotary contacts and fixed contacts along with transition rotor and then a layer of tap terminals at the bottom. The main contact coupling or connector in the main embodiment described below is around and about a main axle of the arrangement with an appropriate electrical coupling set up between them.

The drive and mechanical couplings are the mechanisms to drive and operate the tapping arrangement whilst maintaining a vacuum with typically means to control the degree of rotation and a direction of change device to change the direction of tap changing operation.

The seal permits motion of the drive and the circular movement mechanism whilst maintaining a tight vacuum.

The driving motor itself controlled by a controller provides the desired continuous circular movement with typically means to control direction The rotary contacts and fixed contacts are at the core of a tapping arrangement. The rotary contacts connect with the fixed contacts to a main terminal in the housing wall about an axle in order to realise the desired tapping operation. The transition resistor is used to divert the electrical current in order to maintain the on-load power during the tap change operation. Possibly the transition resistor or more normally transition resistors can be attached to the rotor arm or arms with an epicyciodal movement but by using roller ring connectors as described later the transition resistor may be fixed in the housing or the wall of the arrangement.

The main and tap terminals are normally moulded as part of the terminal ceramic base. The tap terminals are directly connected to the tap contacts. Normally there are 6 to 22 (or more) tap terminals along a circle arc with outer pitches configured to meet clearance requirements.

The main terminal is in the wall of the housing about the main axle in the embodiment depicted. Such an arrangement further allows a reduction in tapping arrangement size so that the arrangement may be up to a ninth of the volume of prior arrangements with a smaller volume maintained in a vacuum. It will also be understood that a main terminal and associated coupling connections may be more easily provided for each transmission phase of an electrical current flow with the main terminal provided in the wall of a housing of the tapping arrangement.

Key to the tapping arrangement and method of operation is the speed of change-over and the switch over path of the rotary contacts. A by-pass circuit with the transition resistor is provided with a transition time for whole tapping operation of normally at least 40 ms. Nevertheless, in the switch over or tapping operation heat will be generated which may lead to malfunction and degradation of the tapping arrangement. Heat above normal operational levels for the arrangement will be generated during a number of steps during switching but most notably the worst situation is when the rotary contact is breaking the circuit. This is due to the presence of an electrical arc generated from the moment the fixed contact breaks with the rotary contact until the moveable rotary contact is far enough away for the arc to be extinguished. Normally the rotary contact is in connection with the main terminal and the fixed contacts with the tap transformer coils. To reduce the problem the time duration of the contact breaking process should be as short as possible but at least half the phase period of the electrical power in order to prevent re-ignition of the arc between the contacts during the breaking process. Normally the heat generated in the transition resistor or resistors is minimal in comparison with that generated by the electrical charge arc.

Figure 1:
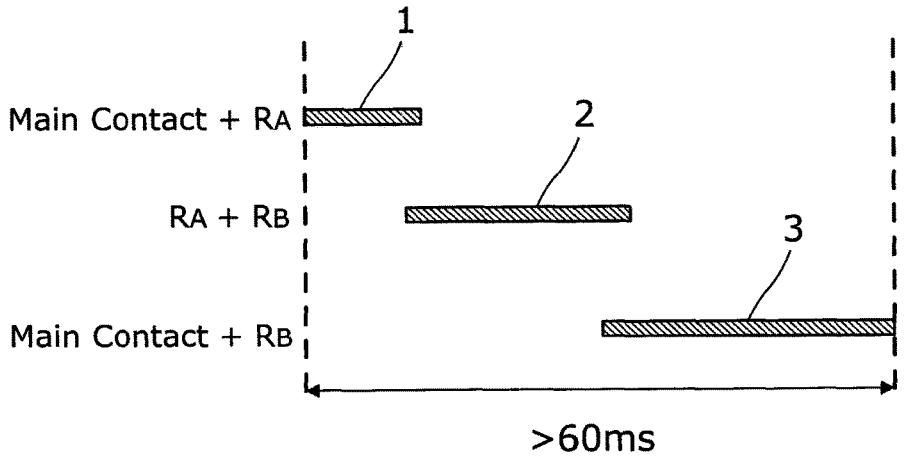
FIG. 1 is a graphic representation of a tapping change-over with a tapping arrangement in accordance with aspects of the present invention.

FIG. 1 provides a graphical illustration of the time periods for a change over in a tapping arrangement with a contact through a first transition resistor $R_A$ for a first period 1 then through the by-pass circuit with the load on transition resistors $R_A+R_B$ for a second period 2 and then the contact through a second transition resistor $R_B$ for a third period 3. The period 1 will normally be greater than 12 ms (typically 20 ms) with the period 2 in by-pass circuit 2 longer than the period 1 and the period 3 longer than the period 3. The period 1 is critical in terms of arcing so is made as abrupt as possible by a loaded bias. The loaded bias as described below can be a spring with a lock release mechanism to rapidly separate the fixed contact and the movable rotary contact when required.

It will be appreciated that in terms of operation of a transformer tapping arrangement it is the change of position of the rotary contact from one fixed tap (original fixed contact) to the next fixed tap (destination fixed contact) which is the means to select transformer coil ratios normally linked to the fixed contacts. A movement locus for the rotary contact is defined so that electrical charge arcing is controlled and so operation of the tapping arrangement achieved to an acceptable level in terms of performance and reliability. The movement locus in a tapping arrangement is defined by drive through a mechanical coupling of circular rotation and rotary/fixed contact layers as defined above. An objective of a specific tapping arrangement design for a particular transformer is to design the movement locus to control the electrical arcs to optimise the movement of contacts within the tapping arrangement for expected operating conditions. The movement of the contacts can be defined as rectangular between contacts with an abrupt upward or perpendicular lift separation between the original fixed contact and moveable rotary contact, a separated normally flat circular rotation then a substantially perpendicular downward return to engagement of the rotary contact with the destination fixed contact.

Figure 2A:
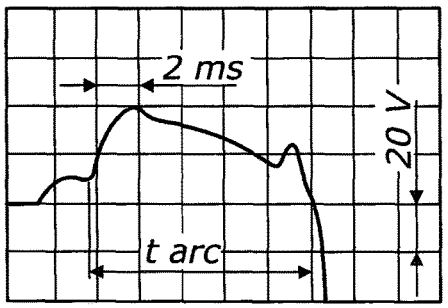
FIG. 2 is a graphic illustration of respectively successful and unsuccessful fixed and movable rotary contact separation in a prior tapping arrangement.
Figure 2B:
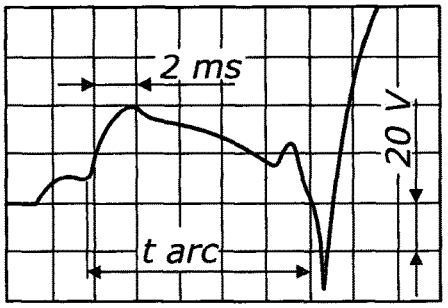

FIG. 2 provides respectively illustrations of a successful contact break in FIG. 2*a* and an unsuccessful contact break with regard to FIG. 2*b*. It will be noted although in total duration the arc t-arc in both successful (FIG. 2*a*) and unsuccessful (FIG. 2*b*) are of similar periods circa 10 ms but the difference is that in a successful break (FIG. 2*a*) at the end the contacts have sufficient gap that the electrical arc is extinguished by gap separation whilst in unsuccessful (FIG. 2*b*) the electrical current still flows as a discharge for a time period across a high voltage with inherent high heat generation.

A normal vacuum interrupter will operate under vacuum levels of about $10^{-4}$ Pa and with the contacts closed the electrical current will flow through the contacts minimising if not eliminating any overheating. When opening under electrical load the contacts will arc leading to high temperatures on the surface of the contacts and this overheating may be quite localised leading to further problems. The arc thermal energy may lead to overheating of the surface of the contacts so contact movement loci should be optimised to control and minimise such detrimental effects. Clearly, rapid separation as with a rectangular path will mean the arc is extinguished more quickly by separation.

Before describing in more detail the movement locus aspects of the present invention some further detail is provided below with regard to contact arcing and operation. The present invention in terms of tapping arrangement operation is intended principally to operate with AC flows. Thus it can be assumed that each contact has an equal probability to be an anode and a cathode during a tap-changing operation. Firstly it will be appreciated that a contact is never perfectly flat so there are microscopic peaks and valleys with current density variations between them and very high temperature in the peaks. An arc always starts from metal vapour produced at spot positions due to high thermal energy at these positions. When the temperature is high enough the spots melt and a molten metal bridge is created which is initially quite stable but as the contacts continue to separate the bridge generally expands as more and more molten vapour is generated. The charged particles increase the electrical conduction between the contacts which results in a sharp expansion of the arc into a diffused column arc. This diffused column arc can also be twisted by the nature of rotary separation of the contacts if separating with a non rectangular locus. In any event the diffused column arc expands as the contacts separate until it spreads across the whole effective area of the contacts. This wider area along with the continuing separation of the contacts means that the plasma density will start to reduce with the diffuse column arc. As there is no further plasma resource available to keep and feed the diffuse column arc expanding the diameter of the arc shrinks to maintain the same maximum volume as the gap between the contacts is increased. The reduction will be most pronounced at a mid-point of the diffuse column so the arc takes the form of a double headed (or twisted) conical arc. This double headed conical arc will break as the contacts separate such that the gap reaches a critical point and the arc is extinguished with lingering comet plasma tails above each contact but the dielectric properties of the gap rapidly recover so that the electrical current falls to zero.

In view of the above it will be appreciated that control of electrical charge arcing is of high importance with respect to achieving efficient and reliable tapping. The movement locus of the rotary contacts should be such that there is rapid separation of the fixed and rotary contacts at each change over with electrical load dealt with by a transition electrical resistor either mounted with the operational rotary contacts attached on each rotor arm or advantageously through a roller to ring association as described later with externally configured transition resistor or resistors secured on the housing. The resistors can be connected in series or parallel to allow selection and/or variation in the capacity of the transition resistor as required.

Figure 12:
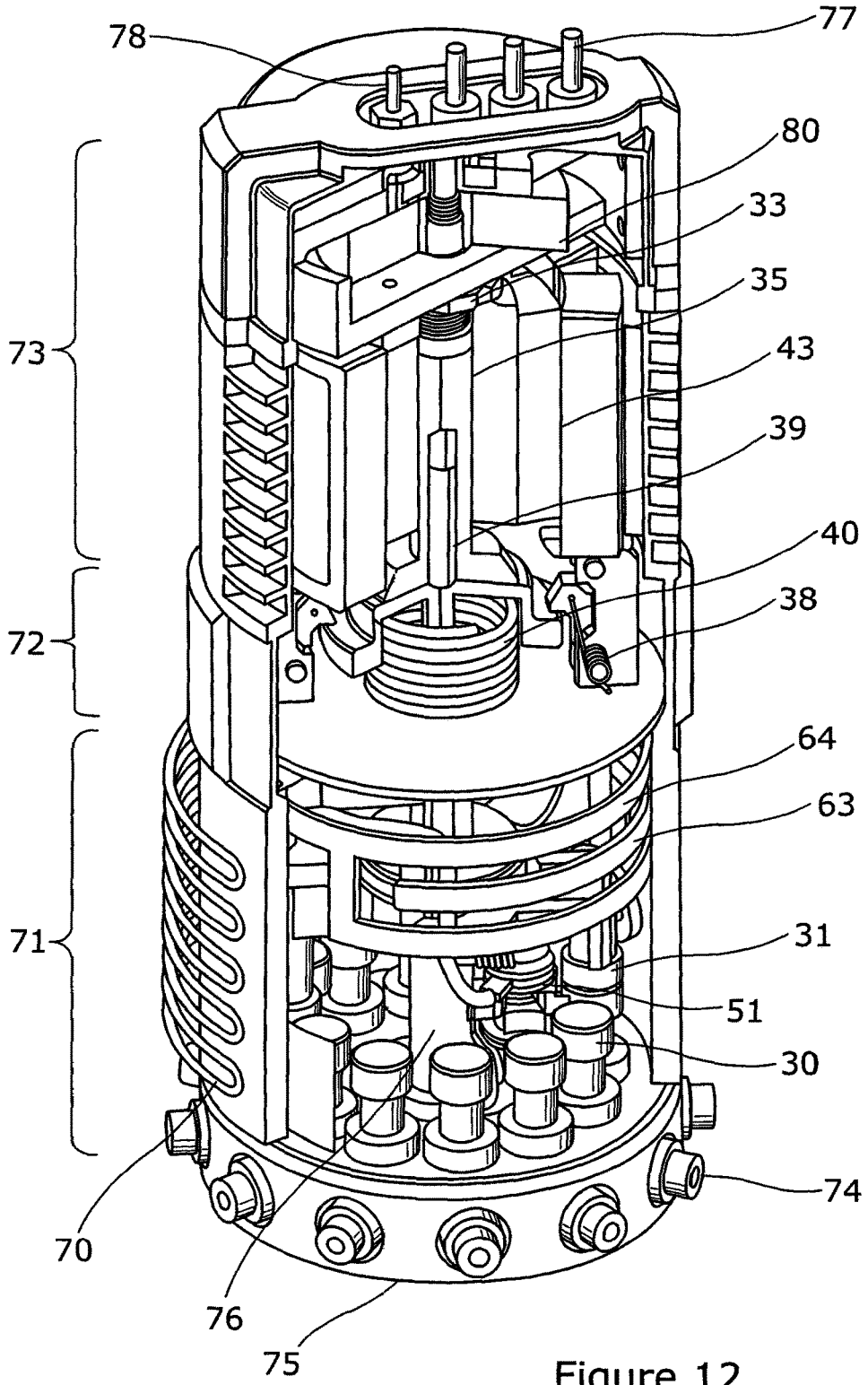
FIG. 12 is a part cutaway perspective cross-section of further details of a tapping arrangement in accordance with aspects of the present invention.
Figure 13:
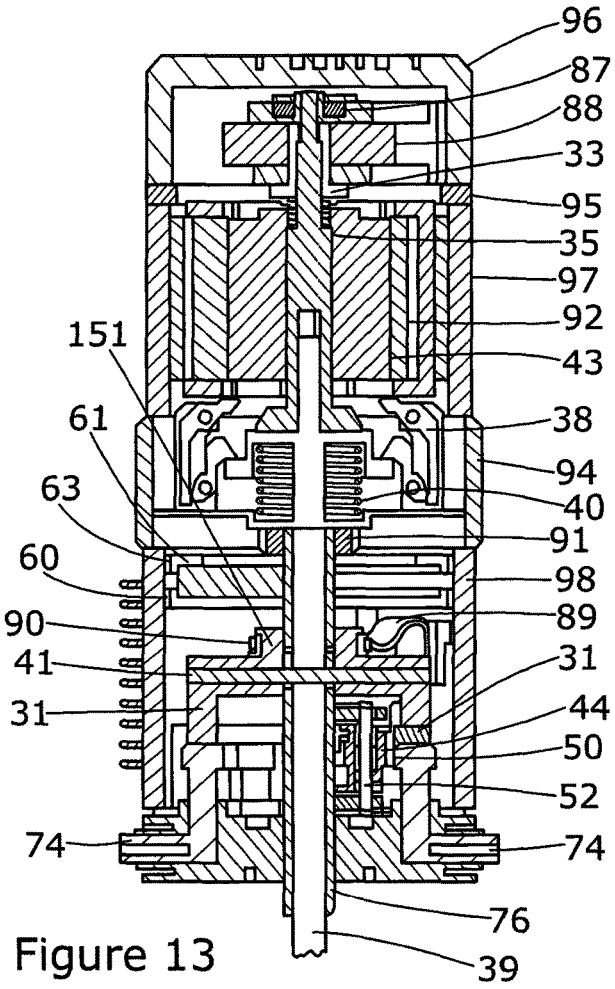
FIG. 13 is a front cross section of the tapping arrangement as depicted in FIG. 12.
Figure 14:
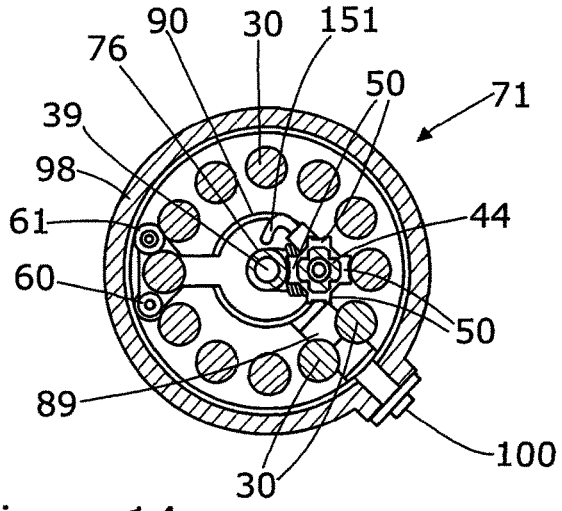
FIG. 14 is a plan cross-section of the tapping arrangement as depicted in FIG. 12 and FIG. 13.

In accordance with aspects of the present invention rotary contact for the operational rotary contacts is separated from a change over arm on a common main axle. In normal operation a rotary contact engages a respective fixed contact with normally a bias to engagement in the form of a compression charged coupling spring held under a lock. The rotary contact is balanced with a member opposite for stability in rotation. During tapping or change over the main axle lifts so that the change-over arm engages the fixed contacts with initially a first transition contact of a pair engaging the original fixed contact and the lock released to allow rapid lift and separation of the original fixed and the rotary contacts then as the main axle turns with the first transition contact still engaging the original fixed contact whilst a second transition contact engages a destination fixed contact in a bridge then finally as the main axle turns further so that the rotary contact as now above the destination fixed contact the second transition contact remains in engagement with the destination fixed contact but the first transition contact is no longer in engagement with the original fixed contact. In any event with the rotary contact now over the destination fixed contact then the main axle is again displaced or depressed with recharging of the bias or other means (coupling spring) so that they can again engage each other. This is the basic means of operation of a tapping arrangement in accordance with aspects of the present invention but greater detail will be provided below with reference to the accompanying drawings FIGS. 3 to 11 showing steps of operation and FIGS. 12 to 14 showing respective front and plan cross-sections of a tapping arrangement in accordance with aspects of the present invention.

Figure 3:
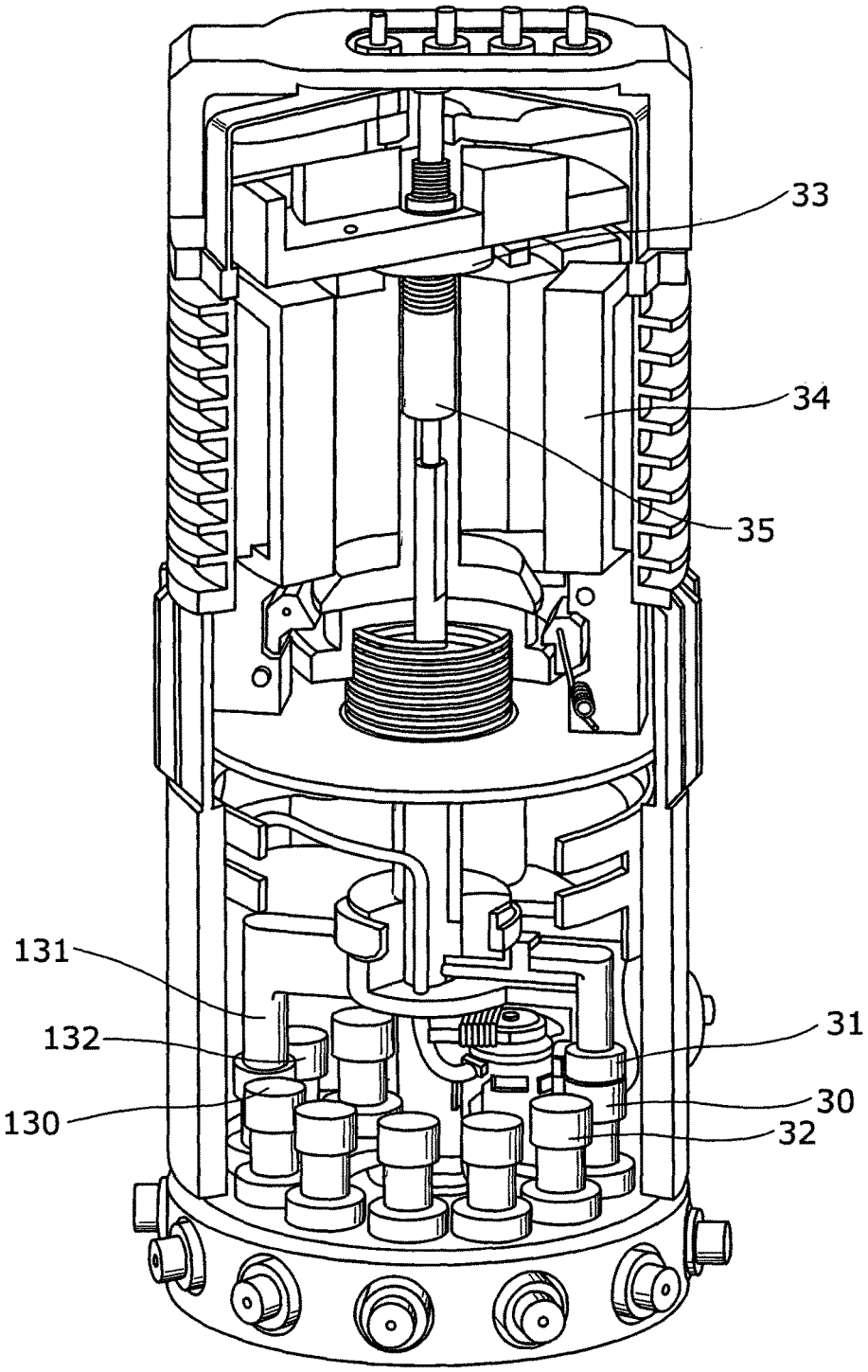
FIG. 3 is a part cutaway cross-section of a tapping arrangement just before a tapping or change-over process.

FIG. 3 illustrates the tapping arrangement ready for tapping or change over so with original fixed contact 30 engaged by rotary contact 31 and a destination contact 32 adjacent the original contact 30. It will be understood that normally tapping will be between adjacent original fixed contacts 30 and destination fixed contacts 32. A clutch disc 33 of a clutch mechanism 80 is locked with a driving motor frame so a clutch axle 35 cannot turn. The contacts 30, 31 control the arrangement and so electrical output from an associated transformer (not shown). It will be noted that the rotary contact 31 is balanced with a rotary member above reciprocal fixed contacts 130, 132 (not in use) for stability in operation.

FIG. 4 illustrates the initial stages of a tap change over in the arrangement. A driving motor rotor 36 begins turning and the clutch axle 35 lifts upon a screw thread so that a bottom plate 37 at the end of the clutch axle 35 also lifts up. Lifting of the plate 37 then releases a coupling lock 38. Release of the coupling lock rapidly also releases a coupling spring 40 associated with a main axle 39 so that the original fixed contact 30 and the movable rotary contact 131 separate quickly reducing the period of arcing before gap distance ensures any arc is extinguished.

Figure 5:
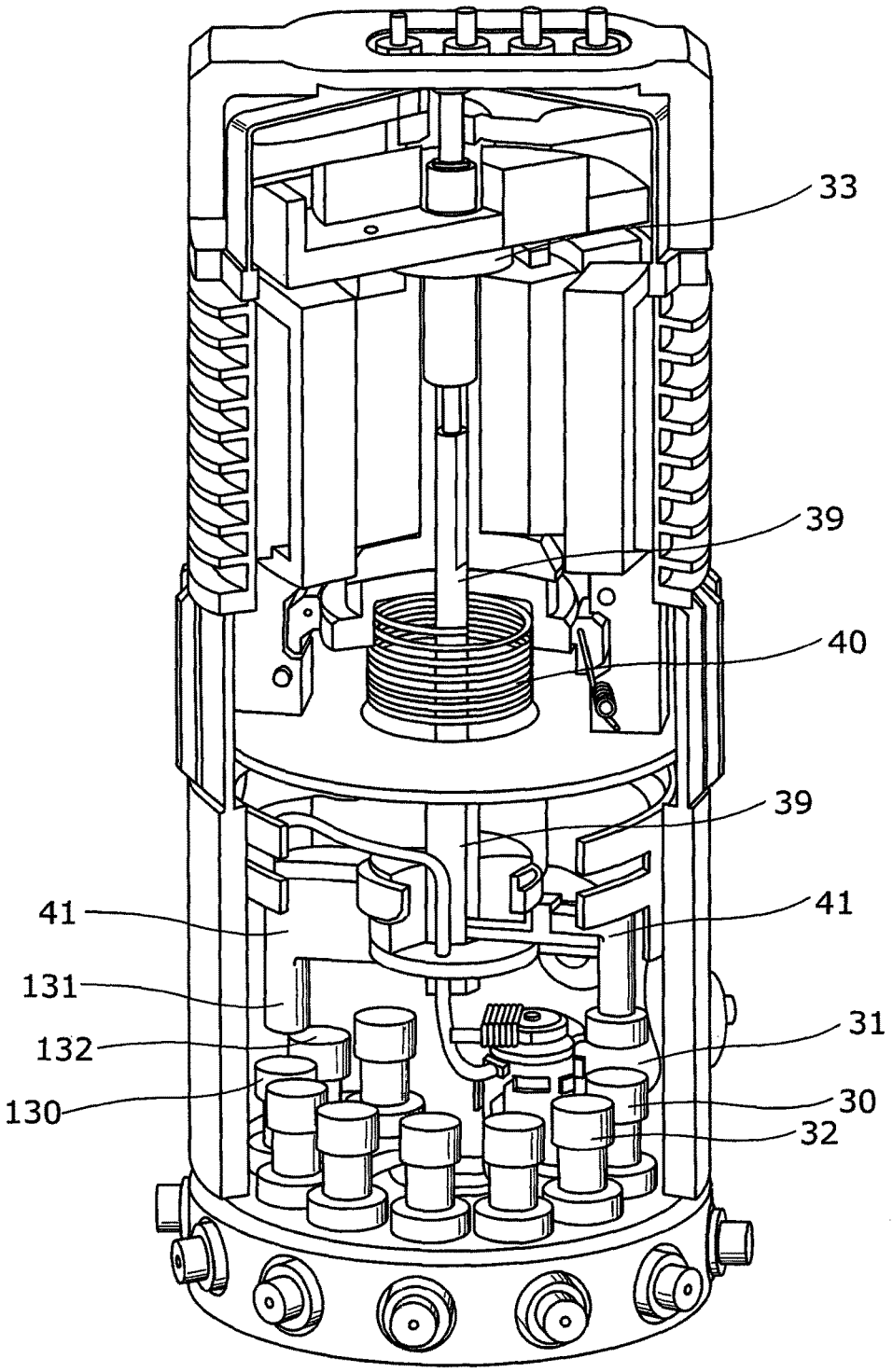
FIG. 5 is a part cutaway cross-section of a tapping arrangement at the stage of breaking of fixed and movable rotary contacts in the tapping or change-over process.

As shown in FIG. 5, release of the coupling lock 38 means that a main axle 39 is pushed or pulled by a now relaxed coupling spring 40 upward along with a rotary contact frame 41. The movement of the frame 41 means that the rotary contact 31 also lifts and a break or rapid opening of a gap occurs between the original fixed contact 30 and its respective movable rotary contact 31.

Figure 6:
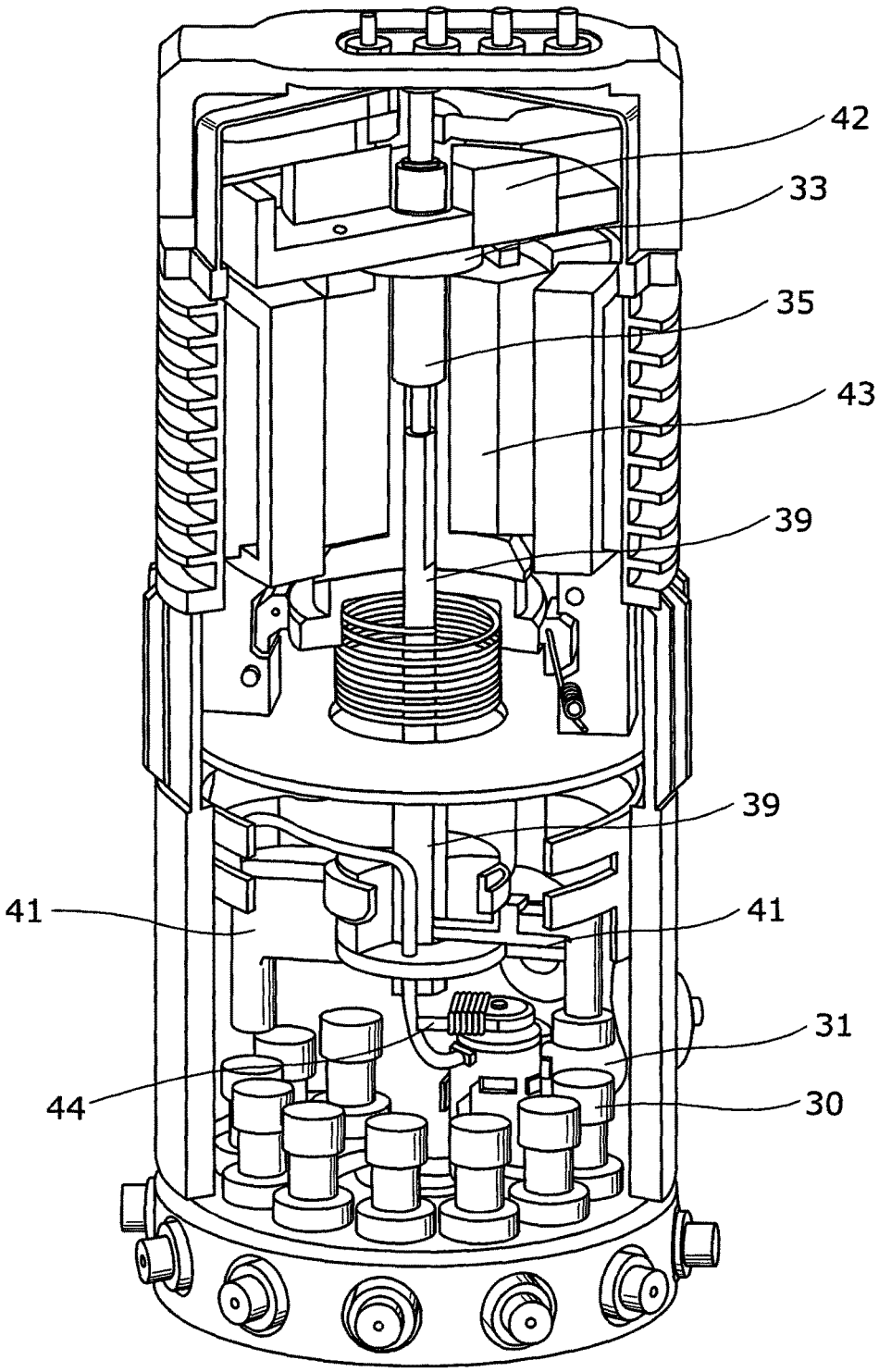
FIG. 6 is a part cutaway cross-section of a tapping arrangement at the stage when the movable rotary contacts begin moving from the original fixed contact position to the destination fixed contact position.

In FIG. 6 it will noted that the clutch disc 33 drops under the bias of a clutch coil 42 so unlocking the disc 33 from the drive motor frame and allowing the clutch disc 33 to engage the motor rotor and rotary contact frame 41 (only for rotating motion). The clutch axle 35 is thereby pushed with the driving motor rotor 43 into engagement with the main axle 39. The main axle 39, rotary contact frame 41 and rotary contact 31 are then turned as with the clutch axle 35. It will also be understood that a tapping transition rotor arms 44 (only one arm is seen but normally two will be provided) and transition contacts (not seen) are also turned with the main axle 39.

Figure 7:
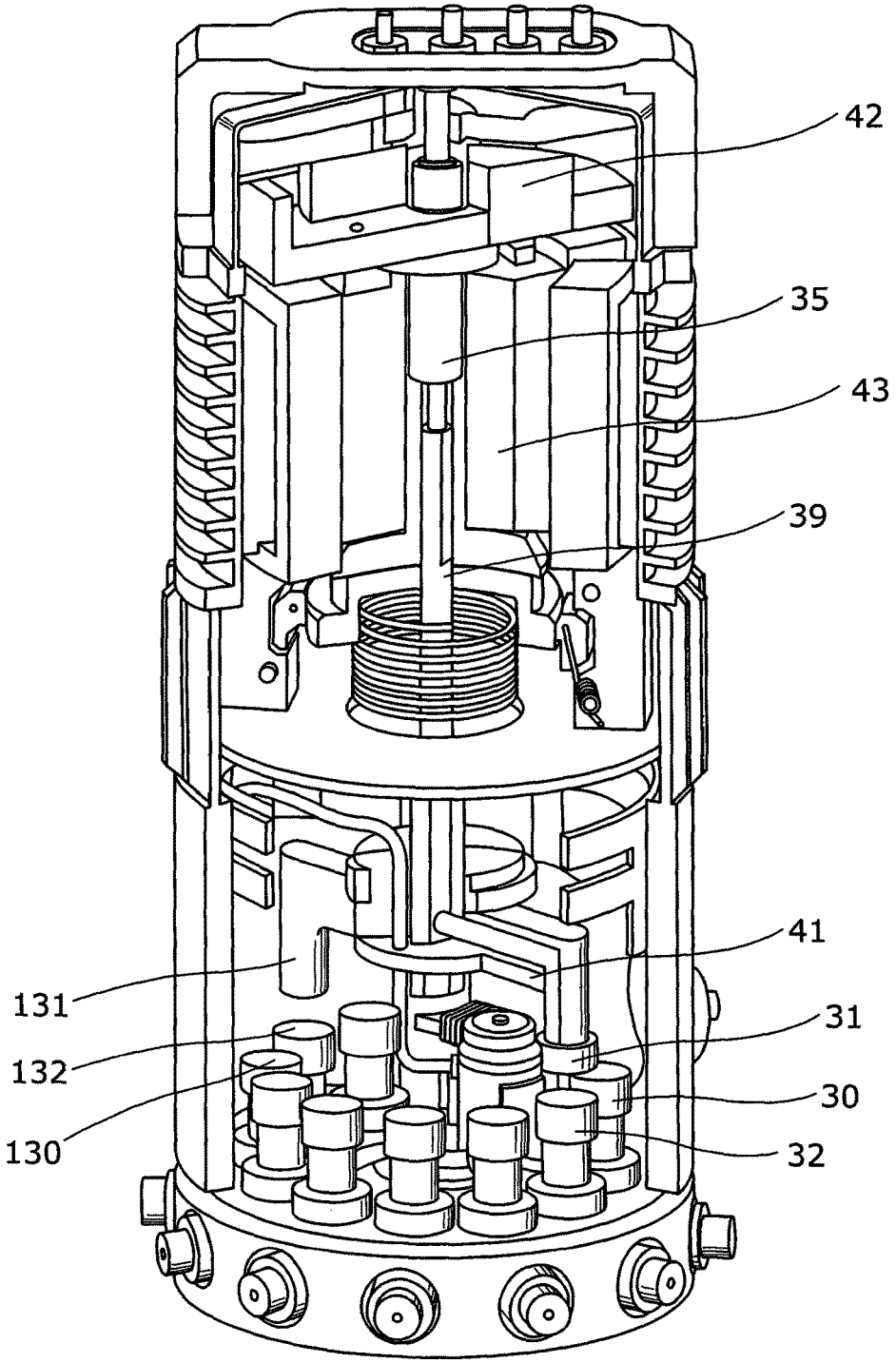
FIG. 7 is a part cutaway cross-section of a tapping arrangement at the stage when the movable rotary contacts stops moving having reached the destination fixed contact position.

In FIG. 6 the rotary contact 31 is essentially above the original fixed contact 30 whilst in FIG. 7 the rotary contact 31 has moved with the frame 41 to be over its respective destination fixed contact 32. The driving motor rotor 43 has stopped and so has the clutch axle 35 turning with the rotor 43. Thus, as indicated the main axle 39, the rotary frame 41 and the rotary contacts 31 have stopped over the destination position which coincides with the destination fixed contact 32. It will also be understood that the tapping transition arms 44 (only one arm se and the transition contacts have also stopped turning at the destination position.

Figure 8:
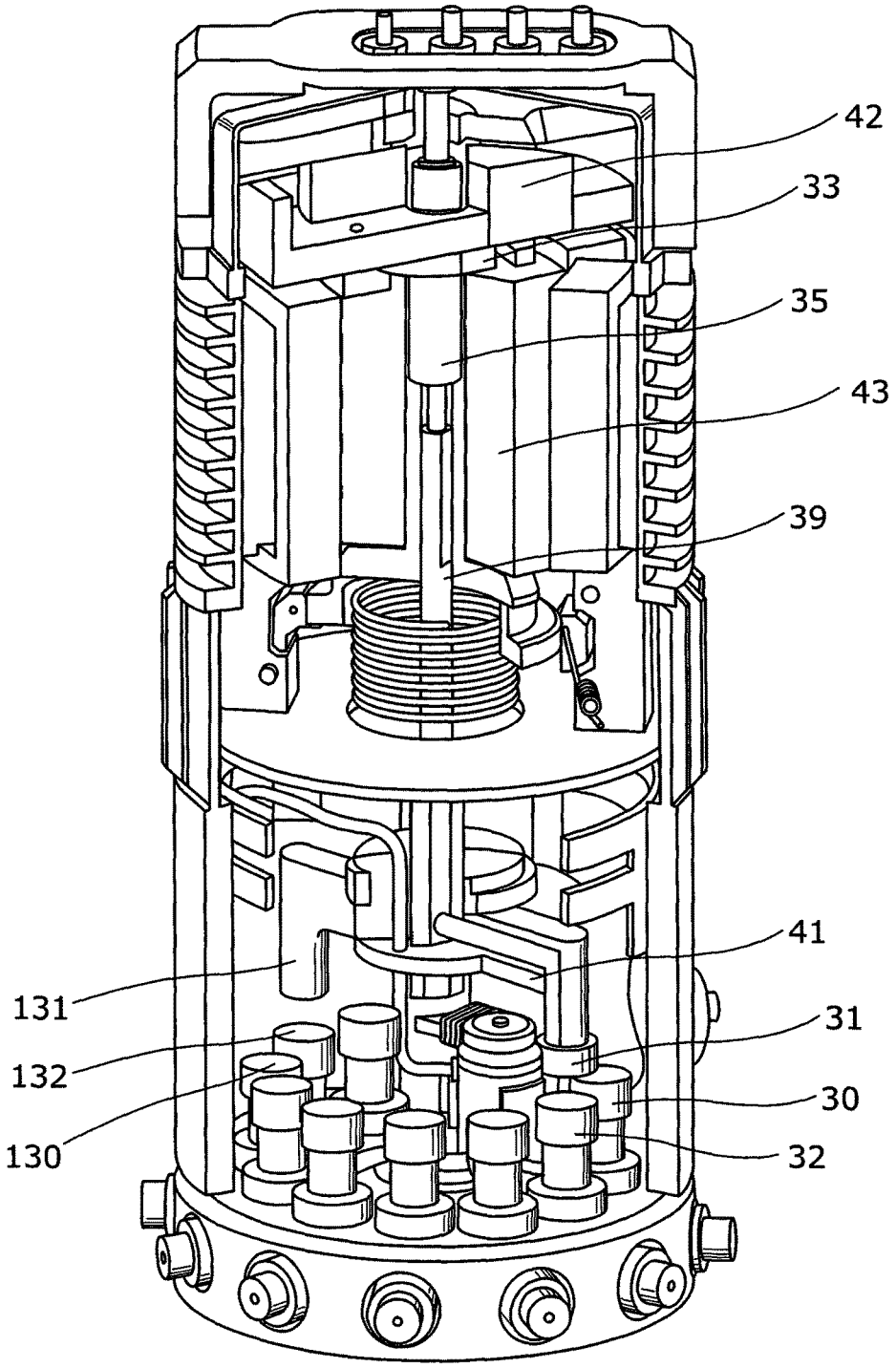
FIG. 8 is a part cutaway cross-section of a tapping arrangement at the stage of preparation of fixed contact to movable rotary contact making engagement.

FIG. 8 illustrates preparation for new destination fixed contact 32 closure with the rotary contact 31. As indicated above rotation has stopped. The clutch disc 33 is again drawn up by the clutch coil from its unlocked state with the driving motor rotor and the disc 33 is again locked with the motor frame to retain arrangement position and configuration.

Figure 9:
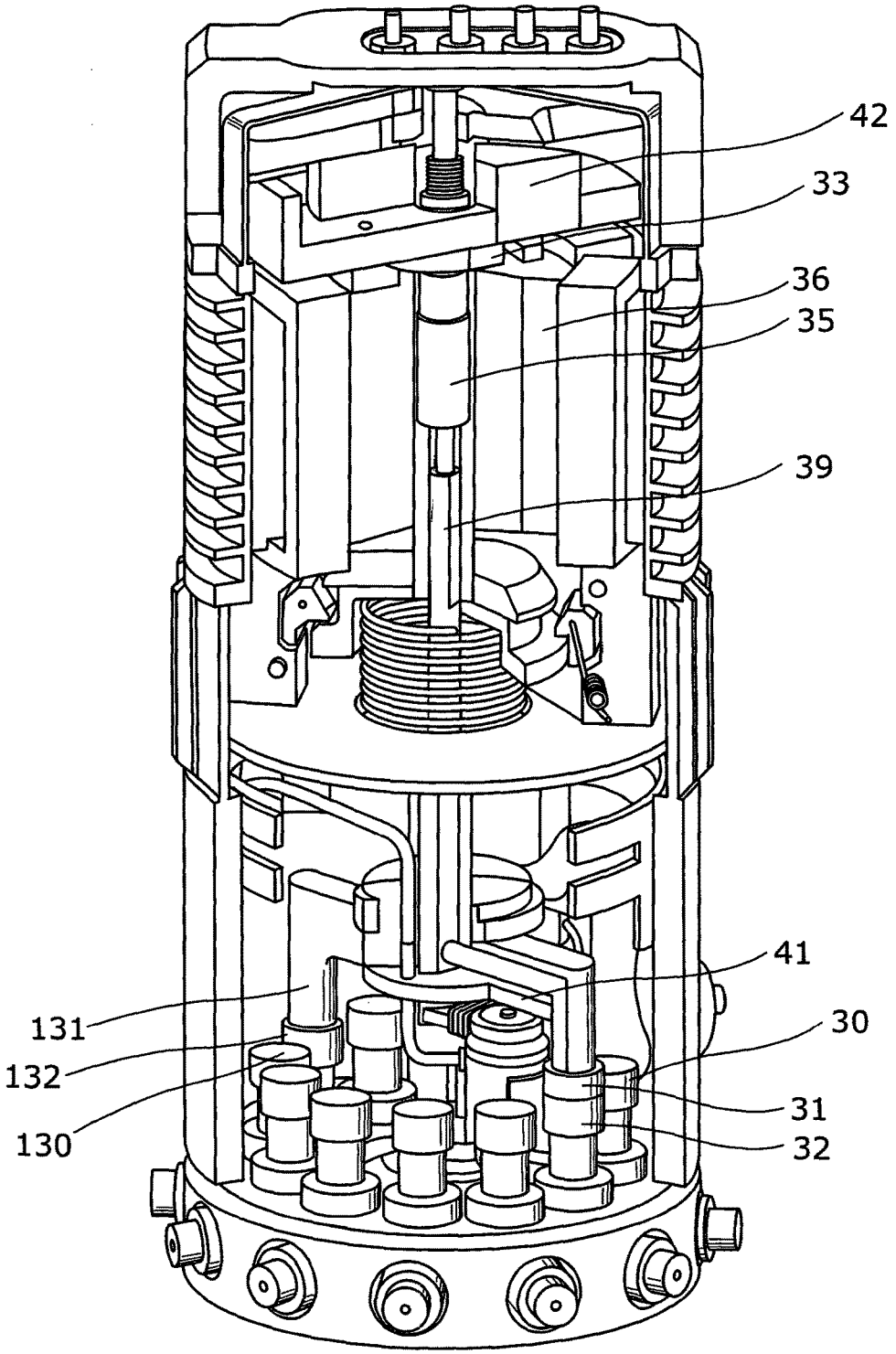
FIG. 9 is a part cutaway cross-section of a tapping arrangement at the stage of fixed to movable rotary contact engagement as the tapping process is achieved.

FIG. 9 shows contact made between the destination fixed contact 32 and the rotary contact 31 so tapping complete. Thus, as previously but in a reverse direction the driving motor rotor 36 turns so that the clutch axle drops down on a screw thread along with the bottom plate 37 and the coupling lock 38 again locks to charge the spring 40. As result of this driving of the bottom plate 37 down the coupling spring 40 again is charged and so provides a bias whereby the rotary contact 31 is forced and depressed/drops down to ensure engagement between the destination fixed contact 32 and the moved or shifted rotary contact 31.

It will be understood on the common axle provided by the split main axle and the clutch axle combination the lift and forced down engagement of the movable rotary contact 31 with the fixed contacts 30, 32 at the start and end of tapping is substantially vertical or perpendicular to the contact surfaces so with the rotation provided as described above the movement locus is substantially or at least more rectangular with clean breaks between the movable rotary contact 31 and the fixed contacts 30. The gaps to extinguish electrical charge arcs will develop much more quickly so that heat generation less significant.

The vertical lift and displacement for coupling spring release and charging along with rotation are all provided by a single prime mover in the form of a motor either of a reluctance or a stepping type.

Figure 10A:
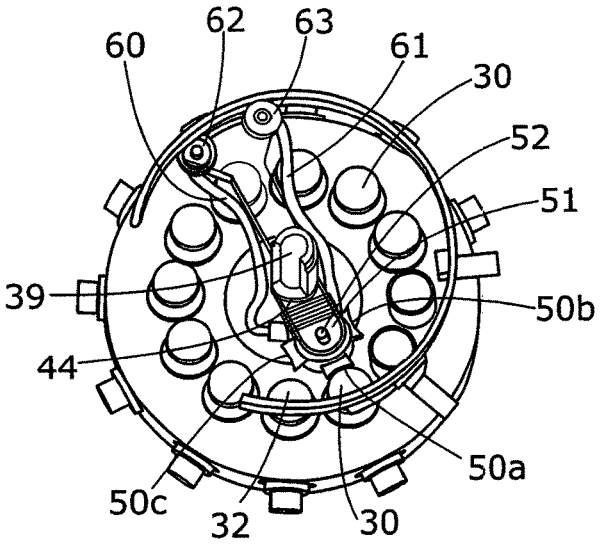
FIG. 10 is a schematic depiction of three stages A B C of transition contact engagement with an original fixed contact and a movable rotary contact during a tapping or change-over process in accordance with aspects of the present invention.
Figure 10B:
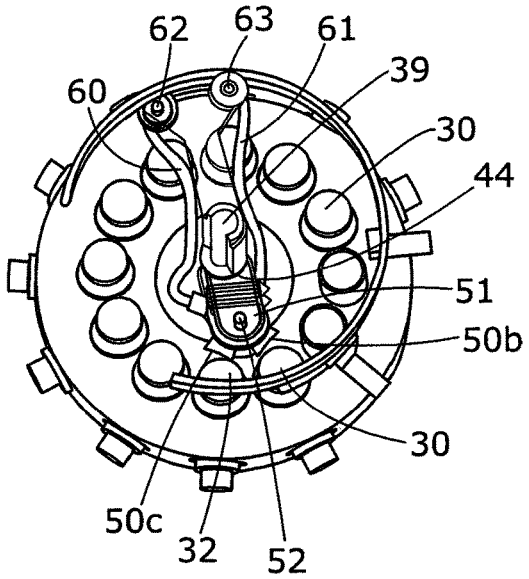
Figure 10C:
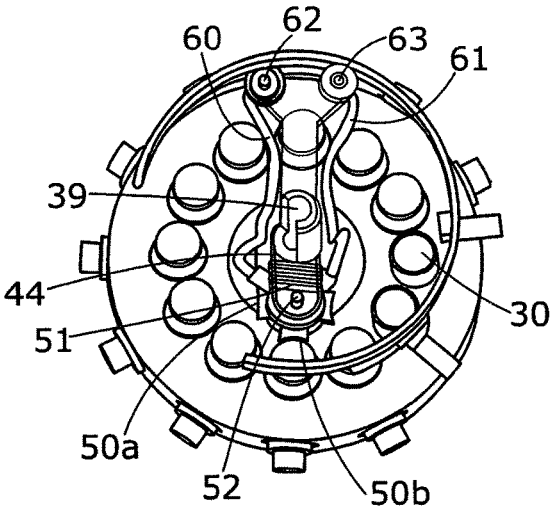
Figure 11:
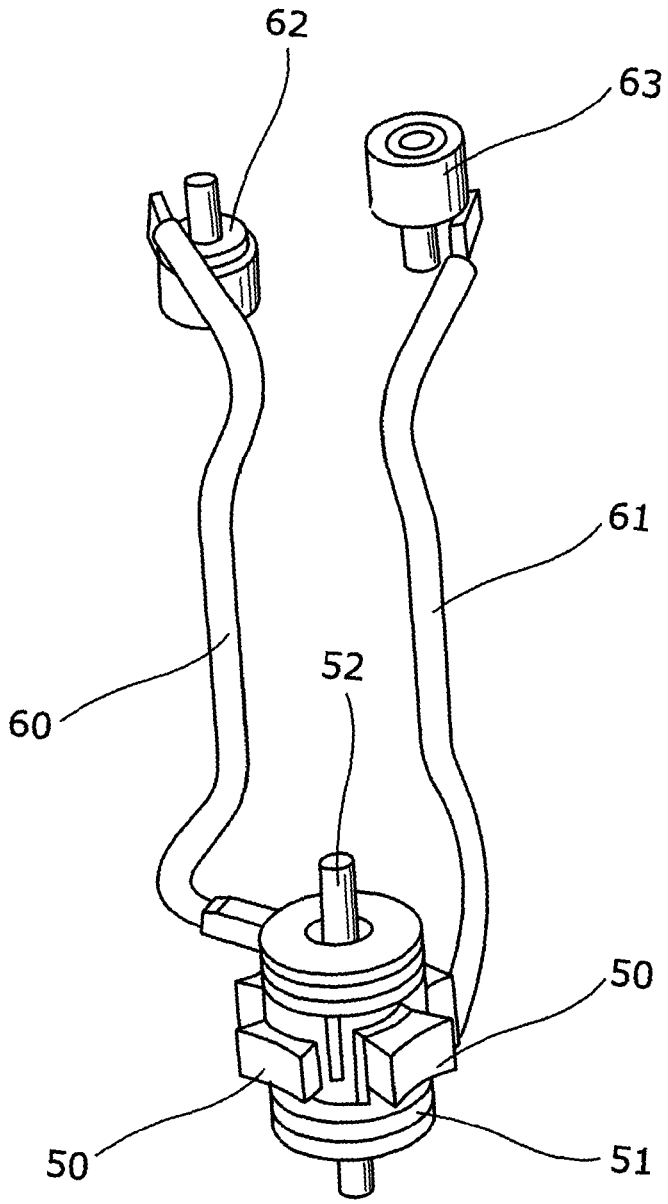
FIG. 11 is a schematic illustration of a transition rotor, transition contacts and roller contact in accordance with aspect of the present invention.

The tapping arrangement depends upon the transition rotor arm or arms 44 and transition contacts 50 in a bi-contact pair as illustrated in FIGS. 10 and 11. As described previously the rotor arm 44 is mounted and associated with the main axle 39 and provides the arm 44 to present a transition rotor 51 with the transition contacts 50*a*, 50*b*, 50*c* etc. The rotor 51 acts about a rotor axle 52 so that the rotor 51 turns to present the contacts 50 as pairs to bridge the fixed contacts and as required as the main axle 39 turns between tap positions for association of movable rotary contact 31 and fixed contacts 30. Adjacent transition contacts are separated and insulated in the rotor 51 by electrical insulation washers but normally opposed contacts are electrically connected. In the embodiment depicted it will be noted that there are four contacts but it is possible to have six or eight provided adequate spacing can be provided for the initial original fixed contact then bridged contact then destination fixed contact rotation process as described.

FIG. 10 illustrates the three principal states for the rotor arm 44 and so transition rotor 51 and transition contacts 50. In FIG. 10A the rotor 51 is positioned with a first transition contact 50*a* engaging the fixed contact. As the rotor arms 44 and so transition rotor 51 turn with the main axle 39 (together with hollow insulating tapping axle 76) as well as self-turning with rotor axle 52 the first transition contact 50*a* moves across the fixed contact 30 and a second transition contact 50*c* is brought into engagement with the destination fixed contact 32 whilst the first transition contact 50*a* gradually detaches as shown in FIG. 10C. At the stage shown in FIG. 10B it can be seen the rotor 51 through its contacts 50*a*, 50*c* as a pair of contacts bridges the fixed contacts 30, 32. Incremental turning of the main axle 39 continues whereby the destination fixed contact 32 eventually is only engaged by the second transition contact 50*c*. It is this motion that allows electrical load normally between the movable rotary contacts 31 and the fixed contacts 30 to be taken by a transition electrical resistor (not shown).

All the transition contacts 50 are always in connection with external transition resistors (not shown) via suitable wires 60, 61 as depicted in FIG. 11. The wires 60, 61 in turn are connected to rollers 62, 63 respectively which move in use in engagement with rings 64, 65 (FIGS. 3 to 11) as the main axle rotates. The rings 64, 65 act as slip or moveable contacts for the rollers 62, 63 so that an electrical connection is maintained. A transition electrical resistance acts and is connected between the rings 64, 65.

As further illustrated in FIG. 10 and FIG. 11 the transition contacts have a recess or other shaping upon an engagement end to facilitate contact engagement with the fixed contacts as the transition rotor rotates through the tapping shift process. The recess or dishing means there is a surface theoretical radius and arc angle of transition contact which should be bigger than radius of the fixed contacts and the angle between two adjacent fixed contacts respectively. Such respective shaping of the fixed contacts and transition contact will aid bridging when required and reduce stressing of the fixed contacts and other parts of the tapping arrangement in use. The transition contacts will be formed from a suitable conductive and normally metal material so may be hard and resilient. In order to maintain good electrically contact the transition contacts may be biased and pushed toward the fix contacts engaged by such as the spring so the electrical contact is maintained but some distortion and/or displacement allowed as the rotor rotates in use between the original fixed contacts to the destination fixed contacts.

As illustrated in FIGS. 12 to 14 a transition resistor 70 is provided externally of the arrangement typically about a section 71 which provides the tapping function with a coupling section 72 and a driving section 73 above it. The respective fixed contacts 30 are coupled to tap terminals 74 in a ceramic base to windings from a transformer (not shown). The main axle 39 generally is within a hollow insulating tapping axle 76 which is held by two taper bearings (not shown) upon which the transition rotor 51 is mounted. At the top of the arrangement are control terminals to provided control signals and power to the drive motor and other devices to control movements of the clutch, the rotor arms with the movable rotary contacts etc. A terminal will also be provided to monitor vacuum within the chamber of the arrangement and particularly the tapping section 71.

The clutch mechanism 30 provides for the movement locus of the tapping arrangement by coupling the drive from driving rotor or motor to the axles to provide lifting of the base plate and so relief of the bias causing fixed contact to movable rotating contact engagement. When separation has occurred the driving motor, which will be a stepping motor or reluctance motor, can drive rotation of the main axle 39 and others along a common longitudinal axis so that a tap circular rotational movement can be performed. By aspects of the present invention the transition rotor and transition contacts move with the main axle 39 and so ensure that load is accommodated during the tap change. The clutch is operated electro-magnetically with a clutch coil 88 to provide displacement of the clutch axle on a clutch bearing 87.

As illustrated in FIG. 13 the main axle defines the common rotational central axis of the arrangement. The tapping arrangement depends upon lift to disengage the fixed and movable rotary contacts used in normal operation with electrical load passing through the current fixed contacts and the movable rotary contacts via a main slip ring 90 and link 89. The main axle rotates relatively freely so a bearing 91 is provided.

The tapping arrangement uses electrical machines such as reluctance and stepping motors. The motor has motor coils 92 to drive motion as required.

The whole tapping arrangement is provided with insulation in the form of a ceramic housing or the like 94 and 98, an isolator ring 95 and top lid 96 along with a radiator 97 for heat from the motor and/or the drive section 73.

FIG. 14 is a plan cross-section of a tapping section 71 showing elements as described previously along with main to slip collar contact associated with the rotary contacts through and at the core of the tapping arrangement. The nature of movement to the transition arm 44 can be seen with the transition contacts 50 acting upon the fixed contacts 30 to bridge original and destination contacts during the transition.

As illustrated the transition resistor will normally by a single high strength element to meet the expected needs of the tapping arrangement and associated transformer. However, it may be possible to provide settable transition resistor levels by a plurality of individual resistors in series or parallel which can be switched into provide the necessary level at initial set up or in a responsive manner during operation. Furthermore an indicator as to electrical flow and load may be provided in the by-pass circuit provided from the transition contacts through the transition resistor. The indicator may be a simple lamp or LED to show electrical current flow or a more sophisticated metering device.

In a preferred embodiment with the transition resistor is externally positioned so it will be understood that replacement of the transition resistor for maintenance or repair is much easier as well as reducing the heat generated in the housing. Furthermore, different size and/or capacity transition resistors can be provided dependent upon expected operational requirements using a base tapping arrangement chassis comprising the other components as described above.

Figures 15A, 15B, 15C, 15D, 15E:
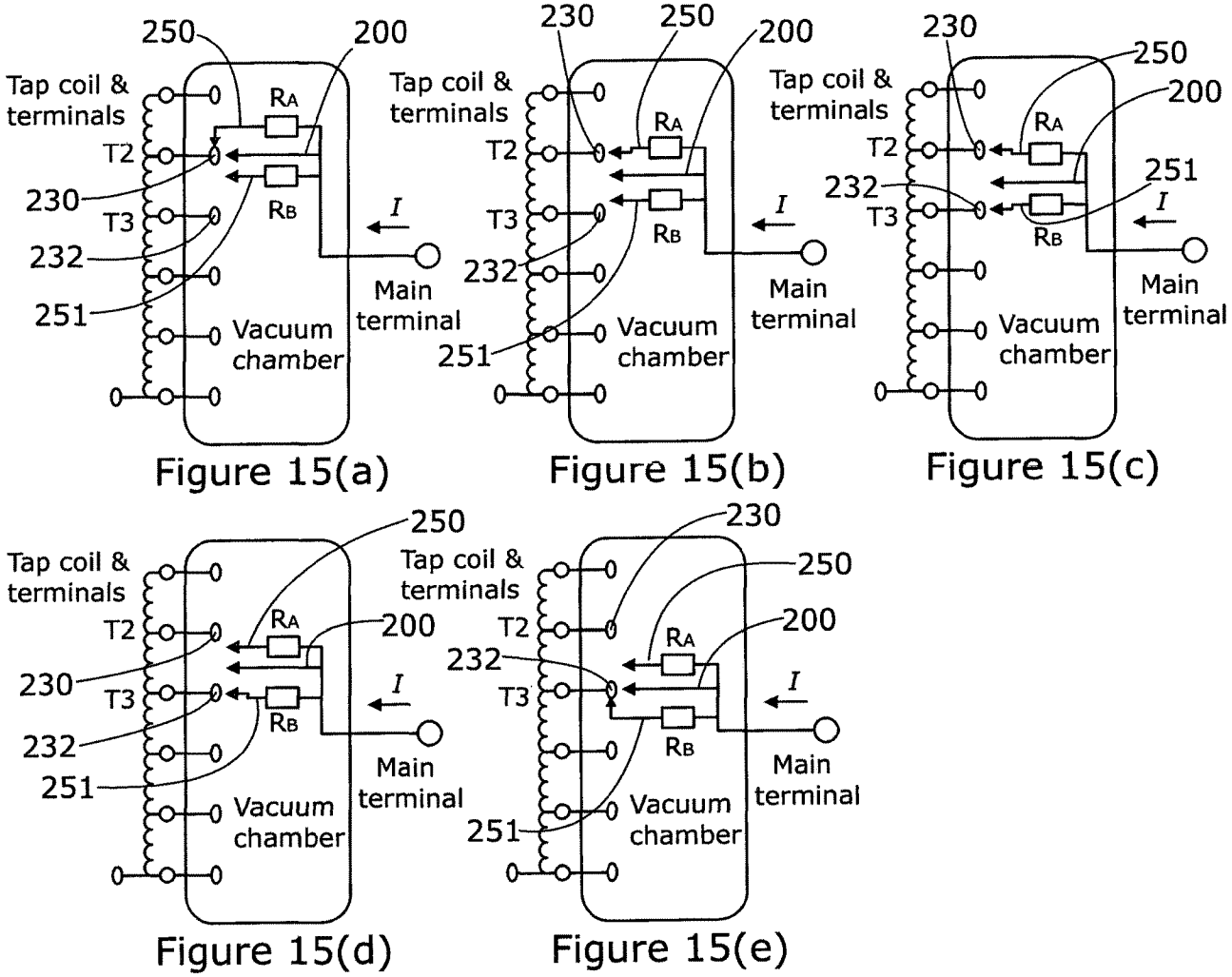
FIG. 15 is a schematic illustration of stages a) to e) of tapping change over in accordance with aspects of the present invention.

FIG. 15 provides schematic illustrations of stages a) to e) of tapping in accordance with aspects of the present invention. FIG. 15(*a*) provides an illustration of the initial stage of tapping shift so a main terminal is connected with a tap coil and terminal T2 in a vacuum chamber through a movable rotary contact 200. It will be noted that all components and parts are in the single chamber except the coupling terminals. A first transition contact 250 engages an original fixed contact 230 at this initial stage of tapping shift. It will be appreciated prior to stage 15(*a*) that the electrical load will pass from the main terminal through the rotary contact 200 only to the tap T2 as a fixed contact.

At stage 15(*b*) the rotary contact 200 has separated as described above rapidly from the original fixed contact 230 to avoid arcing with the first transition contact 250 engaging the contact so that a transition resistor $R_A$ then takes the load for on load tapping in the arrangement. As described above this is rotation process but depicted as lateral in the illustration.

At stage 15(*c*) the movable rotary contact 200 remains above the fixed contacts but a transition bridge is created in that the first transition contact remains in engagement with the original fixed contact 230 whilst a second transition contact 251 engages a destination fixed contact 232 so that on line load passes through the transition resistors $R_A$ and $R_B$ from the main terminal to the fixed contacts 230, 232.

At stage 15(*d*) the rotation continues in the tap shift process so that the first transition contact 250 detaches from the original fixed contact 200 whilst the second transition contact remains in contact with the destination fixed contact 232. The electrical load passes through the transition resistor $R_B$ and the original fixed contact 200 disconnected and so the tap coil and terminal T2 fixed contact.

At stage 15(*e*) the final stage of tapping shift is illustrated with the moveable rotary contact 200 now connected to the destination fixed contact 232 but the second transition contact 251 also attached so load passes through the contact 200 and the transition resistor $R_B$ for a time before further rotation causes dis-engagement of the second transition contact 251 and all electrical load passes through the contact 200 from the main terminal to the tap T3 fixed contact.

The stages a) to e) in FIG. 15 are schematic and it will be understood that the time period at each stage will vary in order to limit the extent and period of any electrical arcing. There will be a rapid lift to separate the rotary 200 and original fixed 230 contacts then rotation then generally slower re-contact of the rotary contact 200 with the destination fixed contact 232.

Typically space is a consideration but there may be 2 to 22 fixed contacts available with typically about a minimum of 15 degrees separation between adjacent fixed contacts so the transition process can be completed in sequence.

A further aspect of the present invention relates to the main connector or terminal in a tapping arrangement. Traditionally the main terminal has been central in the base of an arrangement but with a rotational arrangement such positioning may be inconvenient. An alternative as illustrated in FIGS. 3 to 14 is to provide a main connector or coupling terminal in a side wall of the arrangement, that is to say the ceramic tube or housing 98.

With the main contact connection in the side it will be understood that the rotation of the rotary contacts 31 on their assembly must be accommodated otherwise there will be wind up and other problems. In the further aspects of the present invention the main terminal 100 is fixed in the housing 98 with a link connector or coupling 89 to a collar 151 and slip ring 90 arrangements generally about the main axis 39. The collar 151 and the ring 90 are concentric, in electrical contact with each other and can slide passed each other as the arrangement rotates in a tap shift process. The slip ring 90 is in electrical contact with the main terminal 100 through the coupling 89 and the collar 151 acts as a hub and is in contact with the arm and rotary contacts 31 as well as the transition contacts 50 when required in tapping shift of the arrangement.

The link coupling 89 can be a metal ribbon or wire of adequate capacity but to provide the necessary strength and flexibility it has been found that a wire braided coupling performs best. The coupling 89 must be relatively easily connected to the main connector or terminal 100 as well as the slip ring 90.

The slip ring 90 will slide relative to the collar 151 substantially about the main axle 39 and in the same plane. Lift or fall of the slip ring 90 on the collar 151 should be avoided so generally as illustrated the collar 151 may provide a channel within which the slip ring sits for location or there could be a rail and groove association to maintain an appropriate slide engagement throughout the rotation process during tap shifting.

A good electrical contact between the collar 151 and the slip ring 90 is important but it will be appreciated a tight association may inhibit rotation and may lead to premature wear and tear so a bearing in the form of ball bearings or rollers may be provided between the collar 151 and the ring 90 or a conductive packing strip provided possibly under pressure to ensure good electrical connection in use.

Figure 16:
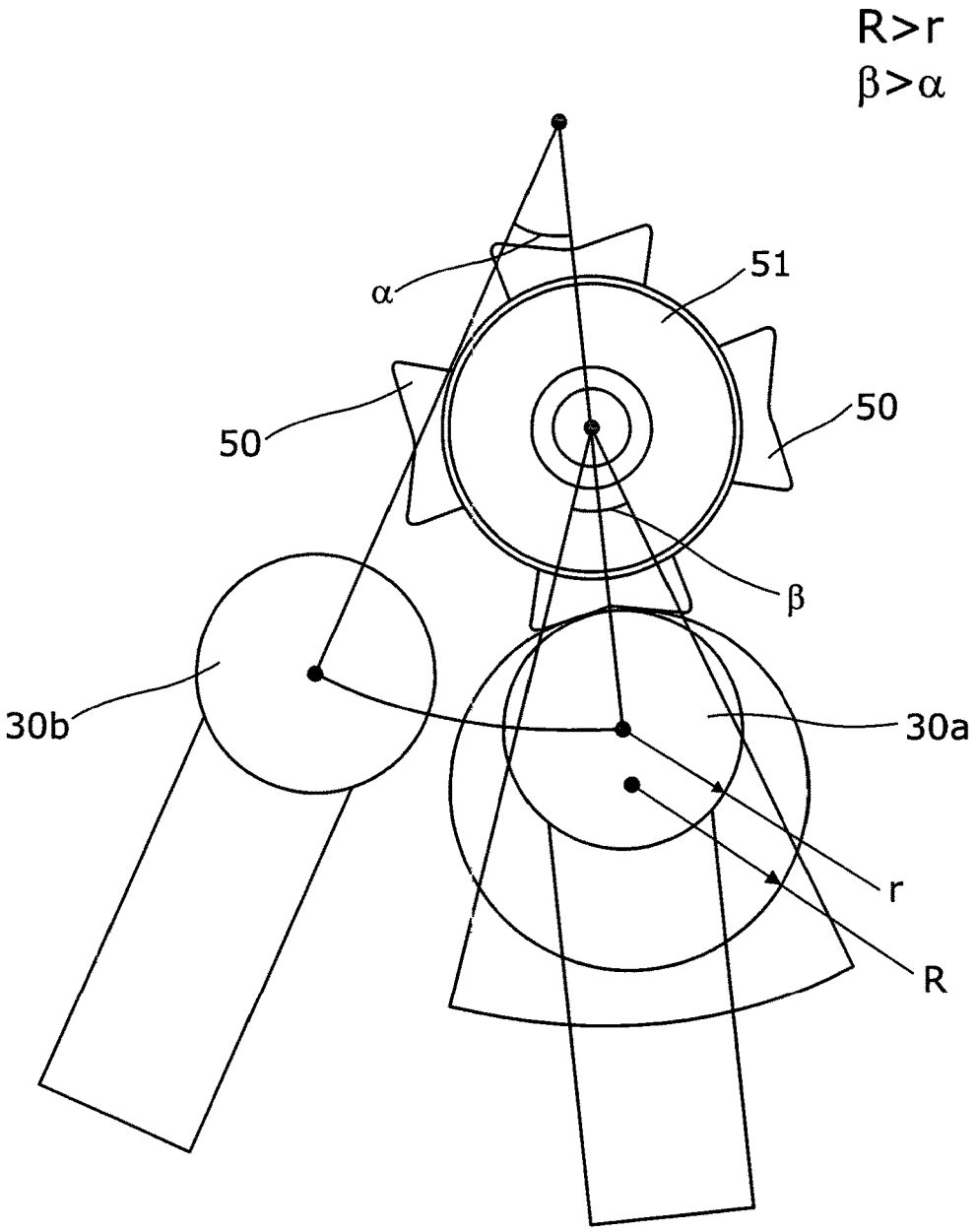
FIG. 16 is an illustration of a theoretical turning process for a transition rotor according to aspects of the present invention.

It will be understood that in terms of the process for transition of the transition contacts between fixed contacts is determined by configuration, sizing and angles between the various components. The actual values for these factors will dependent upon the specific embodiment but as depicted in FIG. 16 with fixed contacts 30 with a radius r then the dish radius R of the transition contacts 50 should be chosen such that the arc $\alpha$ between adjacent fixed contacts 30 (original fixed contact 30*a* and destination fixed contact 30*b*) and the chordal arc $\beta$ between extremities of the transition contact should be in the relationship depicted namely $R>r$ and $\beta>\alpha$. In such circumstance proper transition will be provided with less wear and tear. As depicted normally there are opposed pairs of transition contacts 50 so that as the rotor 51 rotates the contacts move through the process of original contact 30*a* contact, bridging of both original contact 30*a* and destination contact 30 and the contact of the destination contact 30*b*.

In accordance with aspects of invention there is provided additionally or alternatively interrupter couplings and more particularly interrupter couplings used with vacuum interrupters (VI) used with respect to electrical contacts used for example with electrical machines such as transformers (switchgears and tap-changer).

Interrupter couplings are used extensively with regard to situations where electrical contacts make and break particularly a high voltage such as associated with electrical transformers (switchgears). It will be understood that there is a danger of arcing and sparks during such operations so there is a tendency to make and break contacts in a vacuum to avoid the risks of fire, premature degradation of the contacts by oxidation and plasma breakdown (as well as contamination of burned oil).

With a vacuum interrupter (VI) there have always been issues with regard to achieving best results. In general, there are two kinds of the actuators used with vacuum Interrupters; spring mechanisms and magnetic mechanisms. Figure A provides graphic illustrations of the characteristic curves for a spring mechanism 501 and for magnetic mechanisms (permanent magnet 502 & electromagnet 503) with the extension 'a' indicating in an opening or breaking mode and the extension 'b' indicating a closing or making mode of operation. The curve 504 indicates an ideal vacuum interrupter operation so a rapid separation of the contacts at point 505 and a rapid increase in contact loading at contact point 506 at the touching point of the electrical contacts. A spring mechanism (curve 501*a*) matches with characteristic desired curve 504*a* of VI in open operation, but not for closing (curves 501*b* and 504*b*) as there is quite a low contact making force or it is necessary to use a much stronger spring and mechanism with higher cost and size than strictly necessary for opening. With a magnetic mechanism the situation is opposite in that the performance curves 502*b*, 503*b* matches with ideal closing operation (curve 504*b*) rather than open (curve 504*a*). This could reduce the working life of a vacuum interrupter by a low contact breaking speed with a longer than unexpected electric arc and even damaging the vacuum and bellows by very high ending speed while in the open state.

Recently hybrid types of interrupter have been introduced to reduce the problems which occur with both spring mechanism and magnetic mechanism types for more ideal operation of interrupters. These hybrid interrupters use a charged spring for opening and an electromagnetic for closing which also charges the spring for next opening operation. Such hybrid interrupters have better performance in operation but these hybrid interrupters are more expensive to fabricate and have higher operational costs as energy must be used to charge the spring each time in a closing action and hybrid interrupter designs are bigger so accommodation in a switch set might be difficult and of course operation of such hybrid interrupters is much more complex.

In accordance with aspects of the present invention there is provided an interrupter coupling assembly for electrical contacts, the assembly comprising a carriage frame with a contact end and a latch end having a latch element, a driver with a driver end and a driver spring, a magnetic actuator associated with the driver to alternately drive the driver end to displace the contact end to load the driver spring with the contact end so displaced and to drive the driver end away from the contact end of the carriage frame in a first direction to specifically load the driver spring whereby such displacement of the contact end and loading of the driver spring is held by a latch engaging the latch element after desired displacement, the magnetic actuator holds the driver when moved in the first direction and the latch displaceable to release the loading of the driver spring association whereby the contact end in use moves suddenly substantially in the first direction.

The assembly may provide a carriage spring association between the contact end and the latch end adequate in use for wear and tear along with shock absorption. The loading of the carriage spring association may be in tension. The loading of the driver spring may be in compression. The loading of the driver spring may assist the magnetic actuator with regard to driving the driver end to displace the contact end in use. The driver spring may directly abut the latch end of the carriage frame.

The latch may be displaceable radially to disengage the latch element. The latch element may be a flange. The first direction may be toward the latch end. The driver may extend through the latch end. The driver may extend through the latch end. The magnetic actuator may be above the latch end. The latch element may comprise a collar extending away from the latch end. The collar may be adjustable. The collar may comprise an integral portion with the latch end and/or a ring element or elements above the latch end.

The latch may comprise a pivoted peg with one end having a pivot and the other end means such as a tooth or detent to engage the latch element. The latch may include a radial latch spring to drive disengagement with the latch element. There may be a plurality of pivoted pegs generally arranged for balanced loading of the latch element.

The means to displace the latch may be activated by the contact end of the driver in use upon sufficient movement in the first direction engaging parts of the latch. Such engagement may lift the latch whereby when free the latch has a bias to disengagement with the latch element. Such bias may be provided by a radial spring.

Aspects of the present invention provide an interrupter coupling assembly using a magnetic actuator with permanent or electromagnetic operation with a driver spring to give much better performance and nearly perfectly matching the ideal characteristic curve 524 of an interrupter as shown in FIG. 17 in both opening 524*a* and closing 524*b* operations. The present interrupter coupling assembly may be made new as original equipment or can be retrofitted to upgrade existing vacuum switchgears to give better performance at low cost in terms of installation, servicing and production. Furthermore, the actuator used in accordance with aspects of the present invention need not be magnetic so a screw driven actuator with a stepping (electric) motor drive or a hydraulic or pneumatic linear actuator could be used. Such alternative actuators are normally difficult to use in that there is a requirement of a vacuum interrupter to provide an opening operation of 1.0-2.0 m/s speed whilst such actuators are acceptable for closing operations. With an interrupter coupling assembly in accordance with aspects of the present invention such problems of opening operation are relieved to give good performance for a screw driven actuator as shown by curve 526 in FIG. 17. Curve 526*a* is during opening operation and curve 526*b* in closing operations.

In FIG. 17 operation of a conventional hybrid interrupter is shown by curve 521 whilst operation of an interrupter coupling assembly in accordance with aspects of the present invention with a permanent magnet actuator (curve 522), with an electromagnetic actuator (curve 523) and as described above with a screw driven actuator (curve 526). As can been seen the curve 521 is more displaced from the ideal operational curve 524 for an interrupter coupling assembly. Closer approximation to the ideal curve will improve performance of the whole switch gear and operational life due to wear and tear through the make/closing and break/opening actions as described above. As can be seen the present invention in the curves 522, 523, 526 with regard to opening (curves delineated by a)) is relatively consistent and nearer to the ideal curve 524 after an electrical contact separation point 525 in actuator travel. In the closing operation again the curves 522, 523, 526 are relatively consistent with each other and all closely approximate the ideal curve 524 until an electrical contact touching point 526 when the electromagnetic actuator curve 523 is by far the closest to ideal. Thus, it is preferred that an electromagnetic actuator is used in accordance with aspects of the present invention but where other factors are relevant such as cost and space then alternative actuators would or could be used.

FIG. 18 provides a schematic cross-section of an interrupter coupling assembly 530 in accordance with aspects of the present invention associated. The assembly has an actuator 531 and a vacuum interrupter 532 with a fixed contact 533 and a movable contact 534 coupled to the assembly 530.

The contacts 533, 534 are located in a vacuum in use formed within a tube or chamber 535. The action of the assembly 530 is to displace the contact 534 in opening and closing operation as will be described below with movements of a transfer rod 539 in the direction of arrowheads A with a guide of some means to provide linearity of motion and movement.

The assembly 530 comprises a frame with a contact end 536 and a latch end 537 with normally a frame spring association 538 between them but possibly with a rigid frame instead between the ends 536, 537. The association 538 provides for over travel of the frame to offset for any erosion wearing of the vacuum interrupter and mechanical wearing of the frame and suspension to smooth movement shocks in the assembly. The contact end 536 is associated with the transfer rod 539 so that movement of the end 536 causes movement of the rod 539 in a guide.

A driver 540 is located within the frame on a driver spring 541 for opening operations. The driver 540 has a contact element 542 and a driving element 543 such as a flange which engages the latch end 537 of the frame. The driver 540 is associated with the actuator 531 so that the driver 540 can be displaced in the direction of arrowheads B which in turn means that the frame is displaced by engagement with the driving element 543 in the direction of arrowheads A to force contact between the contacts 532, 533 through the rod 539. In such circumstances the spring association 538 absorbs displacement shocks and erosion wear whilst the strength of the actuator 531 provides forcible contact between the contacts 532, 533. The spring association 538 could be omitted or removed so the frame is rigid and fixed but then there would be no shock absorption or means to accommodate wear and tear.

The latch end 537 has latch elements 544 which are engaged by fixed or stabilised latches 545 whilst there is forced contact between the contacts 533, 534 with the driving spring 538 relaxed or generally relaxed between the end 542 and the underside of the latch end 537. The driving spring 538 can be charged or loaded by displacement of the driver 540 in a first direction away from the contact end 536 of the frame whilst the frame remains stationary due to the latch engagement of the latch 545 with the latch element 544 of the latch end 537 of the frame. The latches 545 are fixed so despite the driving element 543 disengaging the latch element 544 that latch element 544 is not released but rather retains its position so the frame and hence the contact end 536 does not substantially move.

The latches 545 are substantially fixed and presented on pivots 546 so that radial displacement urged by radial springs 548 is provided as a bias when there is no retention force due to tension in the latches 545 and other loadings. The end 536 on the driver 540 when a desired displacement is achieved will engage and nudge the pivots 546 so that the latches 545 at a distal end 547 will pivot outwards radially in the direction of arrowheads C releasing the latch end 537 so that with the driving spring 541 loaded and the driver 540 held by the actuator 531 it will be understood the frame will move upwards in the first direction in an abrupt manner as the energy of the driving spring 538 is released. With the frame moving in a first direction which is generally upwards which in turn will displace the rod 539 and so open the contacts 533, 534. In such circumstances the advantageous features of spring actuation for opening and of magnetic or other actuators for closing are provided.

With aspects of the present invention the spring 541 is not loaded during closing so energy is not lost during such action by the actuator and retention along with detriment effects on closing performance. Loading of the spring 541 occurs only when opening is required just prior to separation of the contacts 533, 534 by a shift of the frame by release of the latch 545.

FIG. 19 provides a series of cross-sectional illustrations showing stages of operation of the interrupter coupling assembly 540 depicted in FIG. 18 during opening and closing operations.

Figures 19A, 19B, 19C:
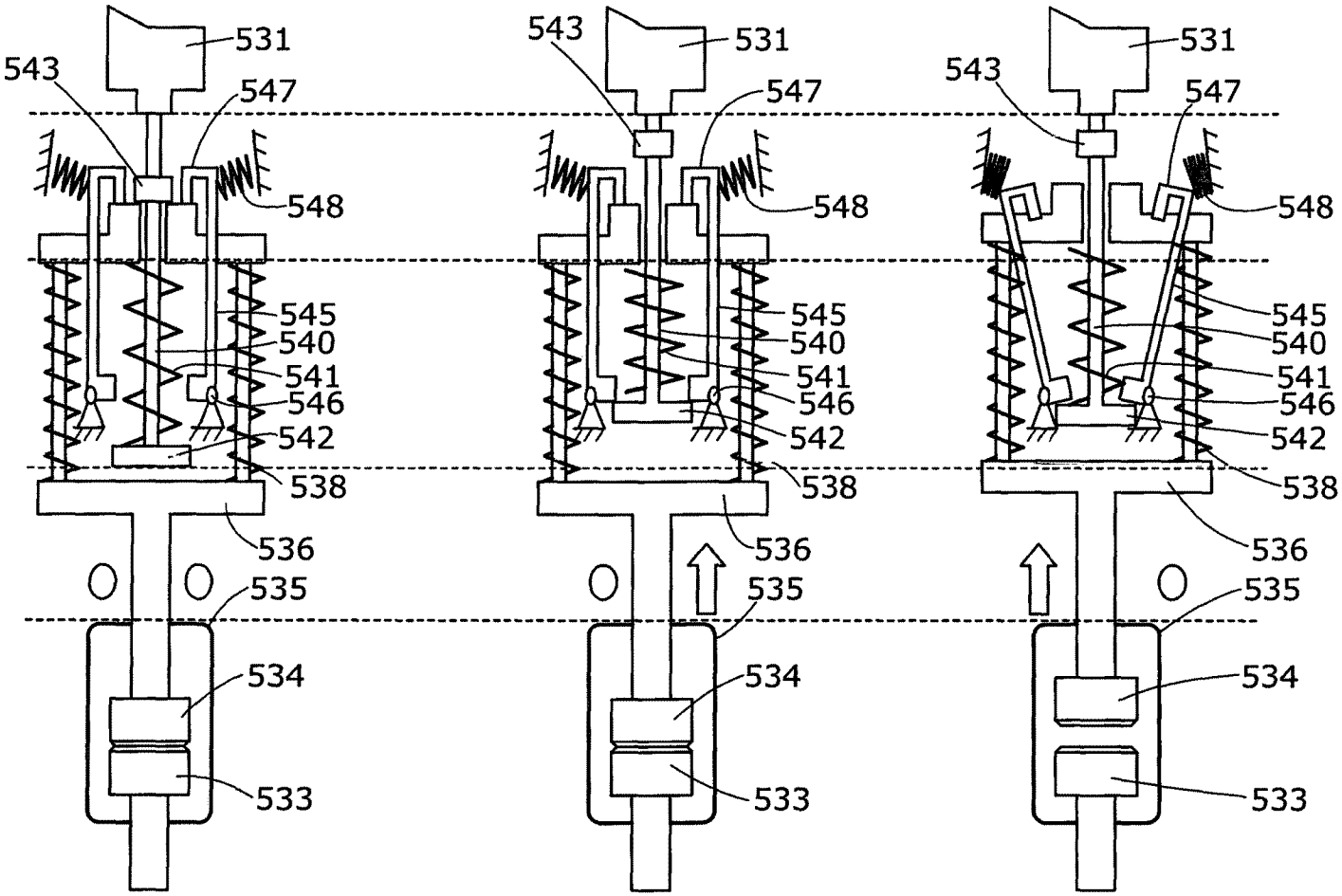

In FIG. 19*a* the assembly 540 in association with the actuator 530 and the vacuum interrupter 532 is illustrated with the contacts 533, 534 closed but ready to open. The driving spring 541 is relaxed. The actuator 530 controls the frame and so the rod 539 so that a desired contact force between the contacts 533, 534 is presented.

In FIG. 19*b* the driver 540 has moved up in the first direction X and the driving spring 541 loaded or charged but with the contacts 533, 534 still held in robust contact with each other by the latches 545 in the form of arms which extend from the fixed pivots 546 at one end and the distal ends 547 latched on to the latch elements of the latch end 537 of the frame. The end 542 as illustrated is just in contact with the pivots 546.

In FIG. 19*c* the end 542 of the driver 540 has turned the pivots 546 so the latches 547 start to release so that the coiled loading of the driving spring 541 is also released to a relaxed state which in turn pulls the frame in the first direction and so contacts 533, 534 apart. The release of the spring 541 will be sudden so that the separation of the contacts 533, 534 will be abrupt which is desirable for the opening operation of an interrupter coupling assembly.

Figure 19D:
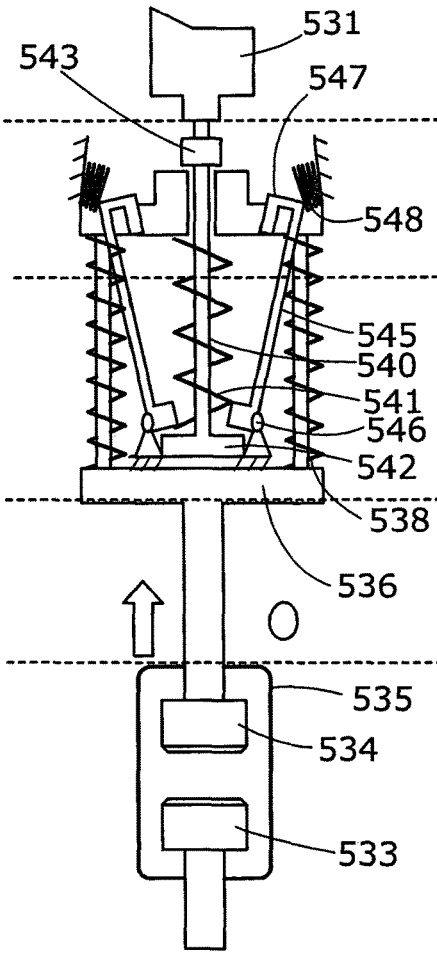

In FIG. 19*d* the driving spring 541 is completely relaxed and so the frame hence the contact end 536 with associated rod 539 displaced away until the frame at the latch end 537 is stopped by the driving element or flange 543. The contacts 533, 534 are now fully open.

Figure 19E:
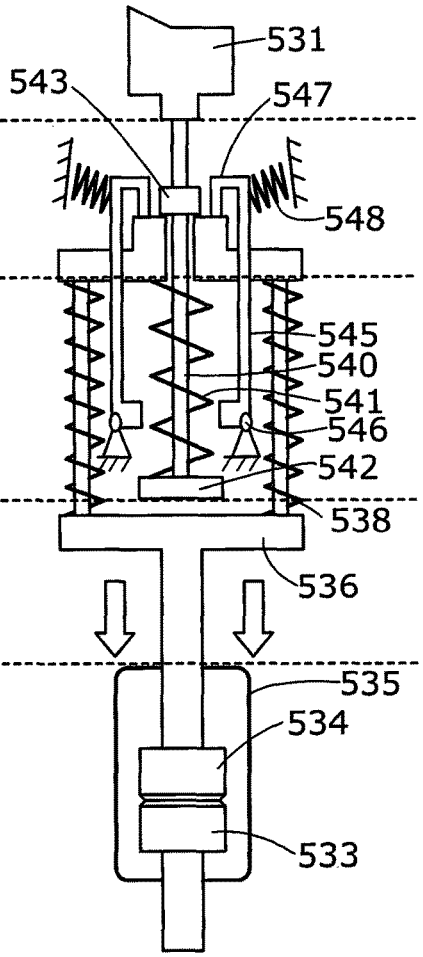

In FIG. 19*e* the driver 540 is displaced in a second direction generally opposite to the first direction so pushing the frame (latch end 537 and contact end 536) towards the contacts 533, 534. The driver 540 is displaced by the actuator 531 and the driver 540 has the driver element or flange in the example shown engaging the frame through the latch end 537 and latch element 544. The contacts 533, 534 close back together as shown under a contact load generated by the actuator and the fixed latches or arms 545 again through distal ends 547 pivot in to a latching position to retain the contacts 533, 534 in association. At the end of the stage depicted in FIG. 19*e* the displacement by the actuator 531 is complete and the whole arrangement is as depicted substantially in FIG. 19*a* with the contacts 533, 534 closed.

FIG. 20 illustrates just the interrupter coupling assembly in accordance with aspects of the present invention in cross-section showing in the FIGS. 20*a* to 20*e* similar stages of operation to those depicted in FIG. 19. Similar reference nomenclature has been used but incremented by 100 so 6xx.

In FIG. 20*a* the assembly is in a closed state but just prior to opening so a driving spring 641 is relaxed with frame comprising a contact end 636 and a latch end 637/644 retained by the latches 647 on their fixed pivot mountings 646. The driver 640 is associated with an actuator (not shown) but the latch holds the contact force between abutting electrical contacts (not shown) which will be associated with the rod 639.

In FIG. 20*b* the actuator (not shown) has displaced the driver 640 with an end 642 so that the driving spring is charged and loaded whilst the frame remains stationary as it is held on the latches 645. Thus, the electrical contacts will remain in forced engagement in a substantially closed state despite there being no load or retention by the actuator (not shown) itself.

In FIG. 20*c* the actuator (not shown) has displaced the driver 640 sufficiently that the contact end 642 engages the pivots 646 upon cam surfaces 600 so that the latches or arms 645 turn outwards radially so that distal ends in the form of detents or teeth disengage the latch element or flange 644. This will release the spring 641 which will then lift the latch end and so frame abruptly in the first direction away from the contacts displacing the rod 639 and so opening or separating the electrical contacts (not shown).

In FIG. 20*d* the spring 641 is fully relaxed again but with the frame displaced upwards so with the electrical contacts (not shown) associated with the rod 639 they too are separated in to an open configuration.

In FIG. 20*e* the actuator (not shown) has displaced the driver 640 in a direction substantially opposite the first direction so the frame and in particular the contact end of the frame is displace along with the rod so that the electrical contacts are forced in to a closed association at the displacement substantially similar to that depicted in FIG. 20*a*.

FIG. 21 provides a front perspective view of the interrupter coupling assembly 630 shown in FIG. 20. It will be noted that the springs 638, 641 and 648 are provided to determine operation of the assembly. The relative strength and configuration of the springs 638, 641 and 648 will be chosen for operational and performance purposes but generally the driving spring 641 is the most powerful to give an abrupt opening separation of electrical contacts, the frame spring 638 associations will be such as to accommodate for wear and shock in the assembly so that the contact end 636 and the latch end 637 are robustly presented but effectively presented on a very stiff suspension suitable for electrical switchgear used in this environment. However, it will also be understood that a fixed frame could be provided with no carriage or frame spring association 638. The radial latch springs 148 are simply to urge radial displacement of the distal ends 647 so are not powerful but adequate for operation whilst easily accommodated in the space available. An alternative might be actuators to displace the latch automatically or specifically when controlled to do so.

It will be understood that the latch element 644 of the latch end 637 with the latch 645 defines the loading or charging of the driving spring 641. In such circumstances the latch element 644 will normally be integrally formed with the latch end 637 either as an upstanding flange or not. Alternatively or in addition for adjustment collars or rings may be placed on the latch end or latch element integrally formed to increase the height of the latch element to which the latch 645 attaches at the distal end 647. This may mean that a different latch 647 length may be needed but might also allow adjustment to improve performance if required or the distance of separation of the contacts by extending the length of the spring 641 when loaded at stages FIGS. 19*b* & 19*c* and FIGS. 20*b* & 20*c* to the open state shown in FIG. 19*d* and FIG. 20*d*.

In the embodiments described above it will be noted that the latch end of the frame provides a guide with the actuator for the driver so limiting the action to in line longitudinal movement. In such circumstances consideration will be made in interrupter coupling assembly design with respect to provide a low friction bearing surface so that resistance to movement is avoided and that an adequate guidance channel or aperture through latch end of the frame directional control of the driver.

It will be appreciated by those skilled in the art that any number of combinations of the aforementioned features and/or those shown in the appended drawings provide clear advantages over the prior art and are therefore within the scope of the invention described herein.

The invention claimed is:

1. A tapping arrangement for a transformer, the arrangement comprising a plurality of fixed contacts and a movable rotary contact upon a main axle, the movable rotary contact movable to engage an original fixed contact and a destination fixed contact upon the main axle by lifting, rotation and depression of the main axle using a lift mechanism, a transition rotor arm associated with the main axle and arranged to rotate with the movable rotary contact, the transition rotor arm having at least two transition contacts that work as a pair, wherein as a rotor end rotates from the original fixed contact to the destination fixed contact, at an initial position, only one of the transition contacts is arranged to engage the original fixed contact, and as the rotor end further rotates to an intermediate position, both the transition contacts are in engagement with the fixed contacts such that a first one of the transition contacts is in engagement with the original fixed contact and a second one of the transition contacts is in engagement with the destination fixed contact, and upon further rotation of the rotor end to a final position, only one of the transition contacts is arranged to engage the destination fixed contact during a tap changeover, the transition contacts connected through at least one transition resistor wherein transition rotor arms are part of a hollow insulating tapping axle which is held by two taper bearings.

2. A tapping arrangement for a transformer, the arrangement comprising a plurality of fixed contacts and a movable rotary contact upon a main axle, the movable rotary contact movable to engage an original fixed contact and a destination fixed contact upon the main axle by lifting, rotation and depression of the main axle using a lift mechanism, a transition rotor arm associated with the main axle and arranged to rotate with the movable rotary contact, the transition rotor arm having at least two transition contacts that work as a pair, wherein as a rotor end rotates from the original fixed contact to the destination fixed contact, at an initial position, only one of the transition contacts is arranged to engage the original fixed contact, and as the rotor end further rotates to an intermediate position, both the transition contacts are in engagement with the fixed contacts such that a first one of the transition contacts is in engagement with the original fixed contact and a second one of the transition contacts is in engagement with the destination fixed contact, and upon further rotation of the rotor end to a final position, only one of the transition contacts is arranged to engage the destination fixed contact during a tap changeover, the transition contacts connected through at least one transition resistor, wherein the lift mechanism has a bias such as a spring loaded element and is held with a lock until released whereby the spring is arranged to stimulate desired rapid separation of the fixed contact and the rotary contact.

3. A tapping arrangement for a transformer, the arrangement comprising a plurality of fixed contacts and a movable rotary contact upon a main axle, the movable rotary contact movable to engage an original fixed contact and a destination fixed contact upon the main axle by lifting, rotation and depression of the main axle using a lift mechanism, a transition rotor arm associated with the main axle and arranged to rotate with the movable rotary contact the transition rotor arm having at least two transition contacts that work as a pair, wherein as a rotor end rotates from the original fixed contact to the destination fixed contact, at an initial position, only one of the transition contacts is arranged to engage the original fixed contact, and as the rotor end further rotates to an intermediate position, both the transition contacts are in engagement with the fixed contacts such that a first one of the transition contacts is in engagement with the original fixed contact and a second one of the transition contacts is in engagement with the destination fixed contact, and upon further rotation of the rotor end to a final position, only one of the transition contacts is arranged to engage the destination fixed contact during a tap changeover, the transition contacts connected through at least one transition resistor, wherein each transition contact is connected to a roller engaging a respective ring with the rings electrically coupled to the transition resistor and the respective rings are substantially concentric about the main axle.

4. A tapping arrangement for a transformer, the arrangement comprising a plurality of fixed contacts and a movable rotary contact upon a main axle, the movable rotary contact movable to engage an original fixed contact and a destination fixed contact upon the main axle by lifting, rotation and depression of the main axle using a lift mechanism, a transition rotor arm associated with the main axle and arranged to rotate with the movable rotary contact, the transition rotor arm having at least two transition contacts that work as a pair, wherein as a rotor end rotates from the original fixed contact to the destination fixed contact, at an initial position, only one of the transition contacts is arranged to engage the original fixed contact, and as the rotor end further rotates to an intermediate position, both the transition contacts are in engagement with the fixed contacts such that a first one of the transition contacts is in engagement with the original fixed contact and a second one of the transition contacts is in engagement with the destination fixed contact, and upon further rotation of the rotor end to a final position, only one of the transition contacts is arranged to engage the destination fixed contact during a tap changeover, the transition contacts connected through at least one transition resistor, wherein the transition contacts are in a pair substantially at a 90° or 60° or 45° or 300 angle to each other on the rotor end.

* * * * *